US008818254B2

(12) United States Patent
Arimoto et al.

(10) Patent No.: US 8,818,254 B2
(45) Date of Patent: Aug. 26, 2014

(54) IMAGE HEATING APPARATUS

(71) Applicant: Canon Kabushiki Kaisha, Tokyo (JP)

(72) Inventors: Kota Arimoto, Kashiwa (JP); Mitsuru Hasegawa, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/655,827

(22) Filed: Oct. 19, 2012

(65) Prior Publication Data

US 2013/0114967 A1 May 9, 2013

(30) Foreign Application Priority Data

Oct. 21, 2011 (JP) ..... 2011-231335

(51) Int. Cl.
*G03G 15/20* (2006.01)

(52) U.S. Cl.
CPC ..... *G03G 15/205* (2013.01); *G03G 15/2053* (2013.01)
USPC ..... 399/329; 399/33; 399/69

(58) Field of Classification Search
USPC ..... 399/69, 328, 329, 330, 331, 333, 335, 399/338; 219/210, 216
See application file for complete search history.

(56) References Cited

U.S. PATENT DOCUMENTS

| | | | | |
|---|---|---|---|---|
| 7,027,075 | B2 * | 4/2006 | Yokoi | 347/156 |
| 7,536,145 | B2 | 5/2009 | Tomine et al. | |
| 7,561,818 | B2 | 7/2009 | Arimoto et al. | |
| 7,684,724 | B2 | 3/2010 | Arimoto et al. | |
| 7,697,881 | B2 * | 4/2010 | Hayashi et al. | 399/399 |
| 7,764,895 | B2 | 7/2010 | Tomine et al. | |
| 7,885,568 | B2 * | 2/2011 | Higashi et al. | 399/69 |
| 7,949,280 | B2 | 5/2011 | Arimoto et al. | |
| 8,005,414 | B2 | 8/2011 | Hasegawa | |
| 8,254,802 | B2 | 8/2012 | Hanashi et al. | |
| 2002/0018664 | A1 * | 2/2002 | Iwasaki | 399/69 |
| 2003/0206745 | A1 * | 11/2003 | Akutsu et al. | 399/33 |
| 2007/0175880 | A1 * | 8/2007 | Iwasaki | 219/216 |
| 2011/0026990 | A1 | 2/2011 | Arimoto | |
| 2011/0129267 | A1 | 6/2011 | Arimoto et al. | |
| 2012/0093547 | A1 * | 4/2012 | Baba et al. | 399/329 |

FOREIGN PATENT DOCUMENTS

| | | | |
|---|---|---|---|
| JP | 2001-75394 | A | 3/2001 |
| JP | 2009-092785 | A | 4/2009 |

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image heating apparatus includes an endless belt having a heat generation layer; a driving rotatable member forming a nip; a pressing pad for pressing the endless belt toward the driving rotatable member; an electric energy supply device for supplying electric energy to the heat generation layer; and a shut-off element configured to break electric connection between the electric energy supply device and the heat generation layer when a temperature of the endless belt reaches a predetermined upper limit temperature, wherein the shut-off element is disposed contacted with the endless belt in a region, with respect to a widthwise direction of the endless belt, outside a passing region of a maximum width of the sheet usable with the apparatus and inside of a heat generating region of the heat generation layer.

12 Claims, 12 Drawing Sheets

IMAGE HEATING APPARATUS

FIELD OF THE INVENTION AND RELATED ART

The present invention relates to an image heating apparatus (device) for heating an image on a sheet of a recording medium. More specifically, it relates to an image heating apparatus (device) usable for a copying machine, a printer, a facsimile machine, a multifunction machine capable of functioning as two or more of the preceding machines, etc., for example.

In recent years, in the field of an electrophotographic image forming apparatus, fixing apparatuses (devices) which are substantially smaller in thermal capacity than conventional fixing devices have been proposed in order to satisfy users of an electrophotographic image forming in terms of how quickly the apparatus starts up. One of the methods proposed to reduce a fixing apparatus (device) in thermal capacity is to use an endless belt as the fixing member (which hereafter may be referred to simply as belt) for the fixing apparatus.

For example, Japanese Laid-open Patent Application proposes a belt-based fixing apparatus which uses an endless belt having a heat generating resistor layer formed of a substance which generates heat as electric current flows through it. This fixing apparatus can heat the entirety of its fixation belt while keeping the belt stationary. Thus, it is substantially smaller than conventional fixing apparatuses, in terms of the amount of heat transferred from the belt to its pressure applying member, which forms a nip between itself and the belt. Therefore, it is significantly smaller than conventional fixing apparatuses, in the length of time required to warm up the belt. Further, its fixation belt does not need to be circularly moved while it is warmed up. Thus, its fixation belt is significantly longer in service life than the fixation belt of any of the conventional fixing apparatuses. In other words, it is substantially longer in service life than any of the conventional fixing apparatuses.

However, the belt is very thin and very small in thermal capacity. Thus, if any of various components of the fixing apparatus, which are not directly involved in the driving of the belt, are in contact with the belt, in the area in which the belt comes into contact with a sheet of the recording medium, the portion of the belt, which is in contact with the component which is not directly involved in the driving of the belt, is likely to more slowly increase in temperature than the rest of the belt, being therefore likely to remain lower in temperature than the rest of the belt. Thus, it is possible that a fixing apparatus, such as the one disclosed in the aforementioned patent application, will output a print suffering from such fixation problems that a part or parts of the image are lower in glossiness than the rest, that toner is missing from a part of parts of the image, and/or the like problem. In order to prevent these problems from occurring to a belt-based fixing apparatus such as the aforementioned one, the apparatus has to be extended in the length of warm-up time, contradicting the desire to reduce the apparatus in the length of warm-up time.

More concretely, one of the members of a conventional belt-based fixing apparatus, which is placed in contact with the fixation belt, is a current blocking element such as a thermal switch which is for blocking the current flow to the heat generation layer of the fixation belt if the belt excessively increases in temperature.

On the other hand, a current blocking element is required to block the current flow to the heat generation layer as quickly as possible if the fixation belt excessively increases in temperature. Therefore, the occurrence of the above-described problems is related to the positioning of the current blocking element(s).

SUMMARY OF THE INVENTION

Thus, the primary object of the present invention is to provide an image heating apparatus, the current blocking elements of which properly function without interfering with the image heating function of its image heating endless belt.

According to an aspect of the present invention, there is provided an image heating apparatus comprising: an endless belt provided with a heat generation layer for heating an image on a sheet; a driving rotatable member cooperative with the endless belt to nip and feed the sheet therebetween and configured to drive the endless belt; a pressing pad configured to press the endless belt toward the driving rotatable member; an electric energy supply device configured to supply electric energy to the heat generation layer; and a shut-off element configured to break electric connection between the electric energy supply device and the heat generation layer when a temperature of the endless belt reaches a predetermined upper limit temperature, wherein the shut-off element is disposed contacted with the endless belt in a region, with respect to a widthwise direction of the endless belt, outside a passing region of a maximum width of the sheet usable with the apparatus and inside of a heat generating region of the heat generation layer.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Typical Image Forming Apparatus

Figure 1:
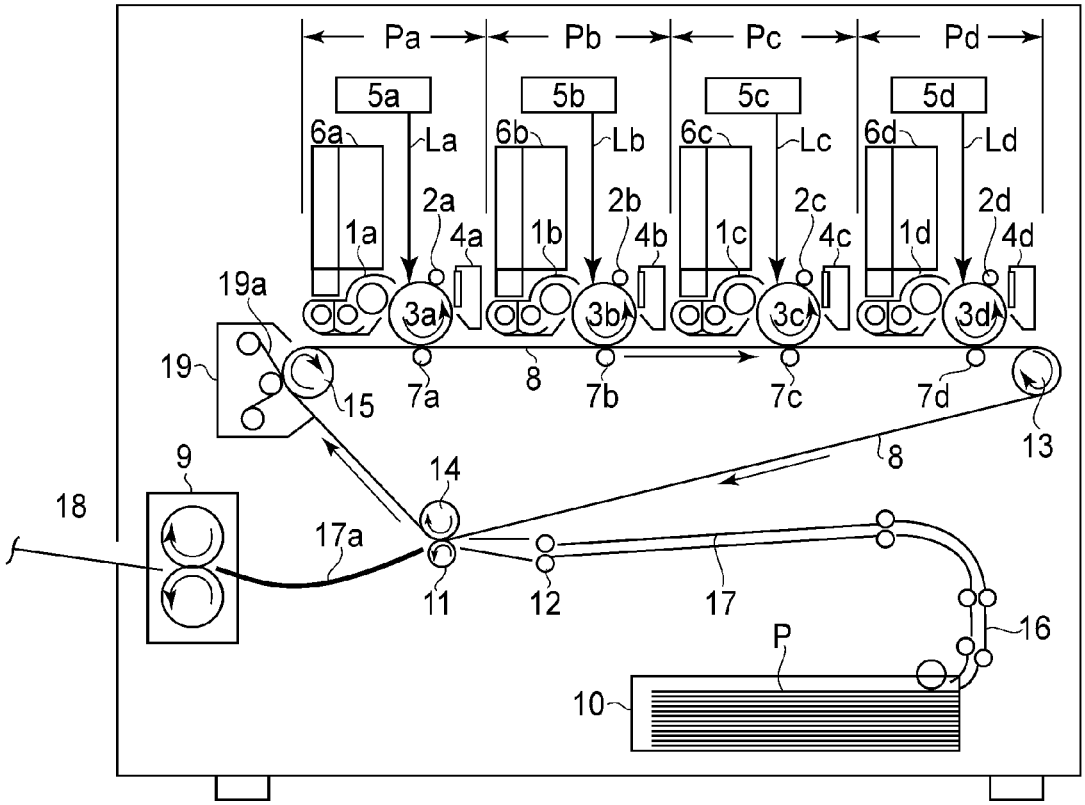
FIG. 1 is a schematic sectional view of the image forming apparatus in the first embodiment of the present invention, and shows the general structure of the apparatus.

FIG. 1 is a schematic sectional view of the image forming apparatus in the first embodiment of the present invention, and shows the general structure of the apparatus. The image forming apparatus in this embodiment is an electrophotographic full-color laser beam printer of the tandem-intermediary transfer type. The apparatus has four image formation stations, more specifically, the first to fourth image formation stations Pa, Pb, Pc and Pd, which are horizontally aligned in tandem. The four image formation stations form yellow, magenta, cyan, and black toner images, one for one, through a process for forming a latent image and a process for developing the latent images.

The image formation stations Pa, Pb, Pc and Pd have their own image bearing member. That is, they have electrophotographic photosensitive member 3*a*, 3*b*, 3*c*, and 3*d*, on which toner images of the aforementioned colors are formed one for one. Further, the image forming apparatus has an intermediary transfer member (intermediary transfer belt) 8, which is positioned adjacent to the photosensitive drums 3*a*, 3*b*, 3*c* and 3*d*.

The toner images, different in color, formed on the photosensitive drums 3*a*, 3*b*, 3*c* and 3*d*, one for one, are transferred (primary transfer) onto the intermediary transfer belt 8, and then, are transferred together (secondary transfer) from the intermediary transfer member 8 onto a sheet P of the recording medium. After the toner images are transferred (secondary transfer) onto the sheet P, the sheet P is introduced into the fixing device (fixing means) 9, which is an image heating device. Then, it is subjected to heat and pressure by the fixing device 9, and then, is discharged, as a finished print, into the external delivery tray 18 of the apparatus.

The image formation stations Pa, Pb, Pc and Pd have also drum charging devices 2*a*, 2*b*, 2*c* and 2*d*, developing devices 1*a*, 1*b*, 1*c*, and 1*d*, primary transfer charging devices 7*a*, 7*b*, 7*c* and 7*d*, and cleaners 4*a*, 4*b*, 4*c* and 4*d*, which are in the adjacencies of the photosensitive drums 3*a*, 3*b*, 3*c* and 3*d*, respectively. Further, the image forming apparatus has laser scanners 5*a*, 5*b*, 5*c* and 5*d*, which are above the photosensitive drums 3*a*, 3*b*, 3*c* and 3*d*, respectively.

The photosensitive drums 3*a*, 3*b*, 3*c* and 3*d* are rotated in the counterclockwise direction indicated by arrow marks, at a preset peripheral velocity. As they are rotated, they are uniformly charged (primary charging) to preset polarity and potential level by the drum charging devices 2*a*, 2*b*, 2*c* and 2*d*, respectively. The uniformly charged (areas of the photosensitive drums 3*a*, 3*b*, 3*c* and 3*d* are scanned by (exposed to) beams La, Lb, Lc and Ld of laser light outputted by the laser scanners 5*a*, 5*b*, 5*c* and 5*d*, respectively, while being modulated with image formation signals. Consequently, latent images which reflect the image formation signals are effected on the photosensitive drums 3*a*, 3*b*, 3*c* and 3*d*, respectively.

Each of the laser scanners 5*a*, 5*b*, 5*c* and 5*d* consists of a light source, a polygonal mirror, etc., and scans the uniformly charged area of the peripheral surface of the corresponding photosensitive drum 5 by rotating the polygonal mirror while deflecting thereby the beam of laser light emitted by the light source. The beam of laser light deflected by the polygonal mirror is focused by an f-θ lens upon the generatrix of the corresponding photosensitive drum 3 (photosensitive drums 3*a*, 3*b*, 3*c* and 3*d*). Consequently, a latent image which reflects the image formation signals is effected upon the peripheral surface of the photosensitive drum 3.

The developing devices 1*a*, 1*b*, 1*c* and 1*d* are kept filled with a preset amount of yellow, magenta, cyan, and black toners (as developers) by toner supplying devices 6*a*, 6*b*, 6*c* and 6*d*, respectively. The developing devices 1*a*, 1*b*, 1*c* and 1*d* develop the latent images on the photosensitive drums 3*a*, 3*b*, 3*c* and 3*d*, into visible images, that is, toner images made of yellow, magenta, cyan and black toners, respectively.

The intermediary transfer member 8 is an endless belt which is suspended and kept tensioned by three parallel rollers 13, 14 and 15. It is rotated (circularly moved) in the clockwise direction indicated by an arrow mark, at roughly the same speed as the peripheral velocity of each of the photosensitive drums 3*a*, 3*b*, 3*c* and 3*d*.

On the peripheral surface of the photosensitive drum 3*a* of the first image formation station Pa, a toner image of yellow color (first color) is formed. As the photosensitive drum 3*a* is rotated, the yellow toner image is transferred (primary transfer) onto the intermediary transfer member 8 while it is conveyed through the nip (primary transfer nip) between the peripheral surface of the photosensitive drum 3*a* and intermediary transfer member 8. This transfer is made by the electric field generated by the primary transfer bias applied to the intermediary transfer member 8 from the primary transfer charging device 7*a*, and the pressure in the nip.

Similarly, the toner images of magenta (second color), cyan (third color), and black (fourth color) formed on the photosensitive drums 3*b*, 3*c* and 3*d*, respectively, are sequentially transferred in layers onto the intermediary transfer member 8. Consequently, a full-color image of the intended original full-color image is synthetically effected on the intermediary transfer member 8.

A reference code 11 stands for the secondary transfer roller, which is kept pressed against the roller 14, that is, one of the three parallel rollers 13, 14 and 15 (by which intermediary transfer member 8 is suspended and kept tensioned), with the presence of the intermediary transfer member 8 between itself and the roller 14, forming thereby the secondary transfer nip between itself and the intermediary transfer member 8.

Meanwhile, one of the sheets P of the recording medium (which may be referred to simply as sheets P) is fed into the main assembly of the image forming apparatus, while being separated from the rest, from a sheet feeder cassette 10, and is delivered through a sheet passage 16, a sheet passage 17, a pair of registration rollers 12, and a pre-transfer guide, to the secondary transfer nip, which is the area of contact between the intermediary transfer member 8 and secondary transfer roller 14, with a preset timing. Further, the secondary transfer bias is applied to the secondary transfer roller 11 from a bias application power source with preset timing. Consequently, the full-color toner image synthetically effected on the intermediary transfer member 8 through the process of transferring in layers the monochromatic color images, different in color, from the photosensitive drums 3*a*, 3*b*, 3*c*, and 3*d*, onto the intermediary transfer member 8, are transferred together (secondary transfer) onto the sheet P.

After the sheet P of the recording medium has received the synthetically effected full-color image, in the secondary transfer nip, the sheet P is separated from the intermediary transfer member 8, and is introduced into the fixing device 9 through the sheet passage 17*a*. In the fixing device 9, the sheet P and the unfixed full-color toner image thereon are subjected to heat and pressure. Consequently, the unfixed full-color toner image becomes fixed to the sheet P. Then, the sheet P is discharged as a finished color print into the external delivery tray 18 of the image forming apparatus.

After the completion of the primary transfer, the residual toner, that is, the toner remaining on the peripheral surface of each of the photosensitive drums 3*a*, 3*b*, 3*c* and 3*d*, is removed by the cleaners 4*a*, 4*b*, 4*c* and 4*d*, respectively, to prepare the photosensitive drums 3 for the formation of the next latent images. The toner and the like contaminants remaining on the intermediary transfer member 8 are wiped away by the cleaning web (unwoven cloth) 19 as they are made to come into contact with the web 19 by the movement of the intermediary transfer member 8.

(2) Fixing Device 9

In the following description of the embodiments of the present invention, the lengthwise direction of the fixing device 9 (which functions as image heating device), and the structural components of the fixing device 9, is the direction perpendicular to the recording medium conveyance direction in terms of the plane which coincides with the recording medium passage. Their widthwise direction is the direction parallel to the recording medium conveyance direction. The front side of the fixing device 9 is the side where the recording medium entrance is present, and the rear side of the fixing device 9 is the opposite side (recording medium exit side) of the fixing device 9 from the front side. Their left and right sides are their left and right sides as seen from the front side of the fixing device 9. Further, their upstream and downstream sides are in terms of the recording medium conveyance direction.

Figure 2:
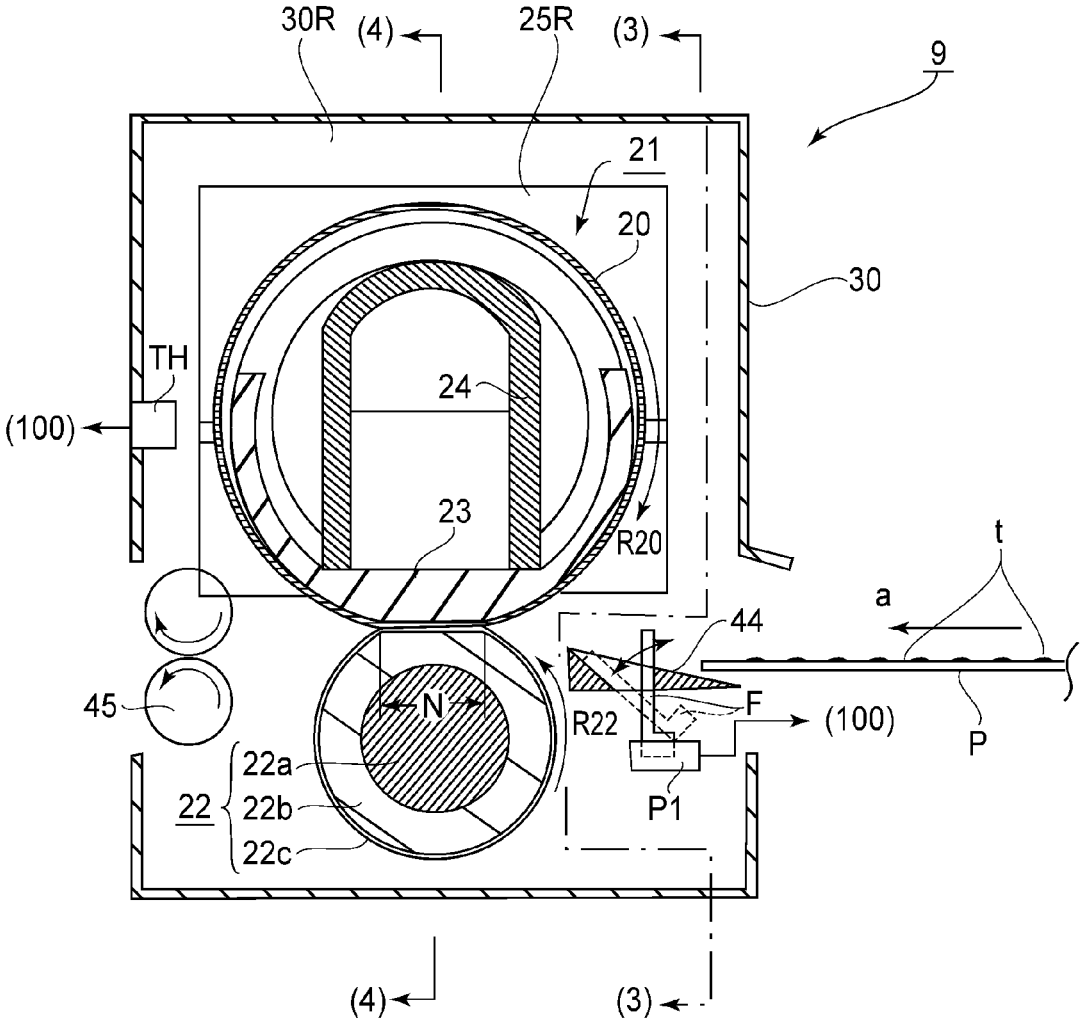
FIG. 2 is a schematic sectional view of the fixing apparatus (device) in the first embodiment, at a vertical plane perpendicular to the recording medium conveyance direction of the apparatus, as seen from the right-hand side of the apparatus.
Figure 3:
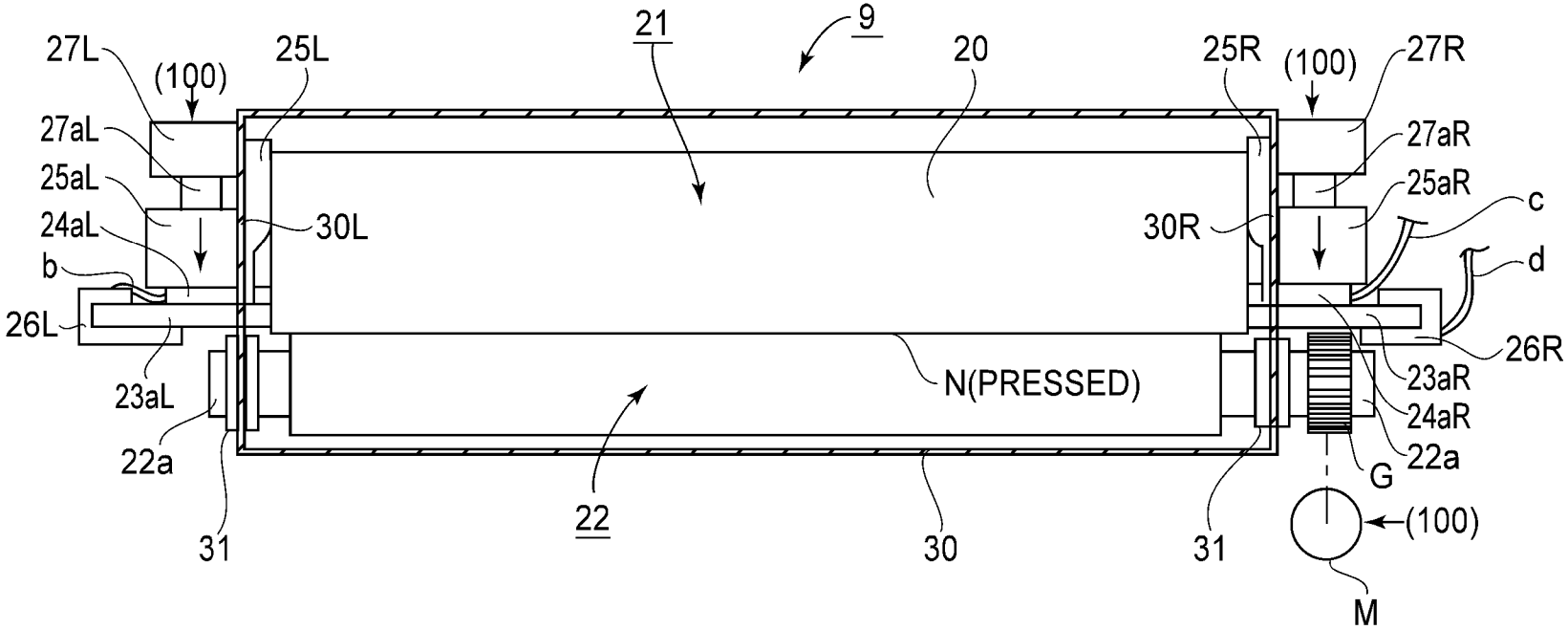
FIG. 3 is a sectional view of the fixing device in the first embodiment, at the vertical plane corresponding to a line (3)-(3) in FIG. 2, as seen from the front side of the device.
Figure 4:
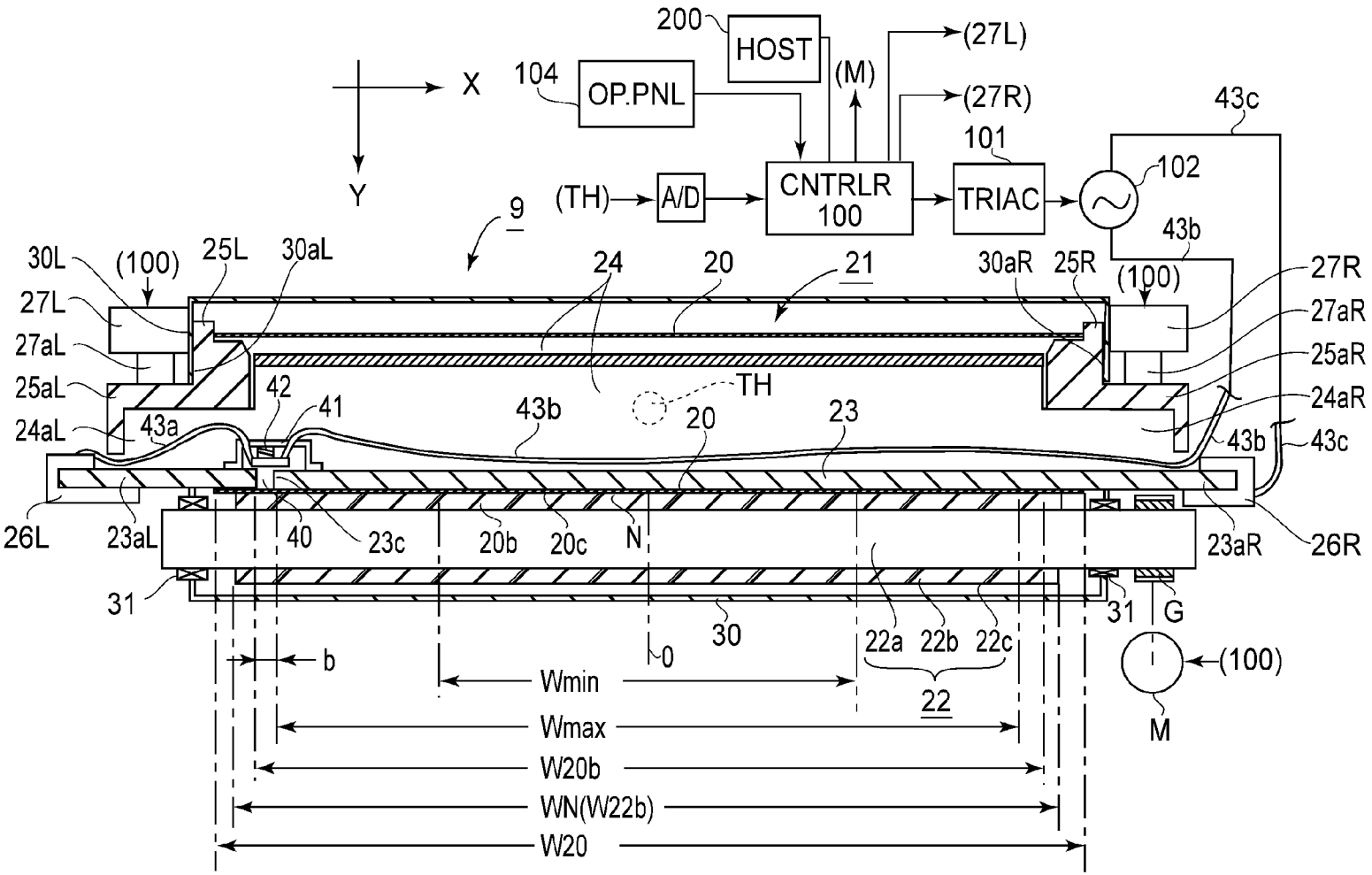
FIG. 4 is a sectional view of the fixing device in the first embodiment, at the vertical plane corresponding to a line (4)-(4) in FIG. 2, as seen from the front side of the device.

FIG. 2 is a schematic sectional view of the fixing apparatus (device) 9 in the first embodiment, at a vertical plane perpendicular to the recording medium conveyance direction of the fixing device 9, as seen from the right-hand side of the fixing device 9. FIG. 3 is a sectional view of the fixing device 9 in the first embodiment, at the vertical plane corresponding to a line (3)-(3) in FIG. 2, as seen from the front side of the device. FIG. 4 is a sectional view of the fixing device 9 in the first embodiment, at the vertical plane corresponding to a line (4)-(4) in FIG. 2, as seen from the front side of the fixing device 9. The fixing device 9 in this embodiment is a fixing device of the belt type. It employs an endless and circularly movable belt 20 as an image heating means for heating a sheet P of the recording medium, and an image t on the sheet P, by coming into contact with the sheet P and the image t thereon. The belt 20 is endless and rotatable (circularly movable). It has a heat generation layer (heat generating section) made up of such a substance that generates heat as electric current is flowed through it.

The fixing device 9 in this embodiment is structured so that when a sheet P of the recording medium is conveyed through the fixing device 9, the centerline of the sheet P in terms of the direction perpendicular to the recording medium conveyance direction, coincides with the centerline of the recording medium passage of the fixing device 9. That is, in terms of the direction perpendicular to the recording medium conveyance direction, the centerline of a sheet P of the recording medium coincides with the centerline of the recording medium passage, regardless of the dimension of the sheet P in terms of the direction perpendicular to the recording medium conveyance direction. Referring to FIG. 4, a reference code O stands for the centerline of the recording medium passage (theoretical line) as the positional reference line for recording medium conveyance. The width of a sheet P of the recording medium is the dimension of the sheet P in terms of the direction perpendicular to the recording medium conveyance direction a, in the plane which coincides with the recording medium passage. Referring also to FIG. 4, a reference code Wmax stands for the path (track) of the widest sheet of the recording medium properly conveyable through the fixing device 9 (width of the recording medium conveyance passage). A reference code Wmin stands for the path (track) of the narrowest sheet of the recording medium properly conveyable through the fixing device 9 (path (track) of narrowest sheet).

Designated by a reference code 21 is a belt assembly, the lengthwise direction of which coincides with the left-and-right direction of the fixing device 9. Designated by a reference code 22 is a pressure roller, which functions as a pressure application member (rotatable member), and the lengthwise direction of which coincides with the left-and-right direction of the fixing device 9. The belt assembly 21 and pressure roller 22 are positioned between the left and right lateral plates 30L and 30R of the frame (chassis) of the fixing device 9, being vertically stacked roughly in parallel to each other. They are pressed upon each other by a preset amount of pressure, forming thereby a fixing nip N, between them, which has a preset dimension in terms of the recording medium conveyance direction a.

The pressure roller 22 is a multilayer roller having a metallic core 22*a*, an elastic layer 22*b*, and a parting layer 23*c*. The metallic layer 22*a* is formed of stainless steel. The elastic layer 22*b* is formed of silicone rubber, and covers virtually the entirety of the peripheral surface of the metallic core 22*a*. The parting layer 22*c* is a piece of tube made of PFA resin, and covers the elastic layer 22*b*. It is roughly 50 μm in thickness. The pressure roller 22 is rotatably supported by the left and right lateral plates 30L and 30R, by the left and right lengthwise ends of its metallic core 22*a*, with the placement of a pair of bearings 31 between the left and right ends of the metallic core 22*a* and the left and right lateral walls 30L and 30R, respectively.

A reference code G stands for a pressure roller driving gear, which is coaxially fitted around the right end portion of the metallic core 22*a*. It is to this gear G that a rotational driving force is transmitted through a driving force transmitting means (unshown) from a motor M which is under the control of a control circuit (CPU, controller) 100, which functions as the means for controlling the apparatus. As the rotational driving force is transmitted to the gear G, the pressure roller 22 is rotated in the counterclockwise direction indicated by an arrow mark R22 in FIG. 2.

The belt unit 21 has an endless (cylindrical) belt 20 (which hereafter may be referred to simply as belt 20), which functions as an image heating member. The widthwise direction of the belt 20 coincides with the left-and-right direction of the fixing device 9. The belt unit 21 has also a belt backing member 23, which functions as a pressure pad. The belt backing member 23 is within the loop which the belt 20 forms, and guides the belt 20 from within the belt loop. Further, the belt unit 21 has a belt backing member supporting stay 24, which is on the inward side of the belt backing member 23 with reference to the belt loop. Further, the belt unit 21 has left and right flanges 25L and 25R, with which the left and right lengthwise ends of the supporting stay 24 are fitted, respectively.

1) Belt 20

Figure 5:
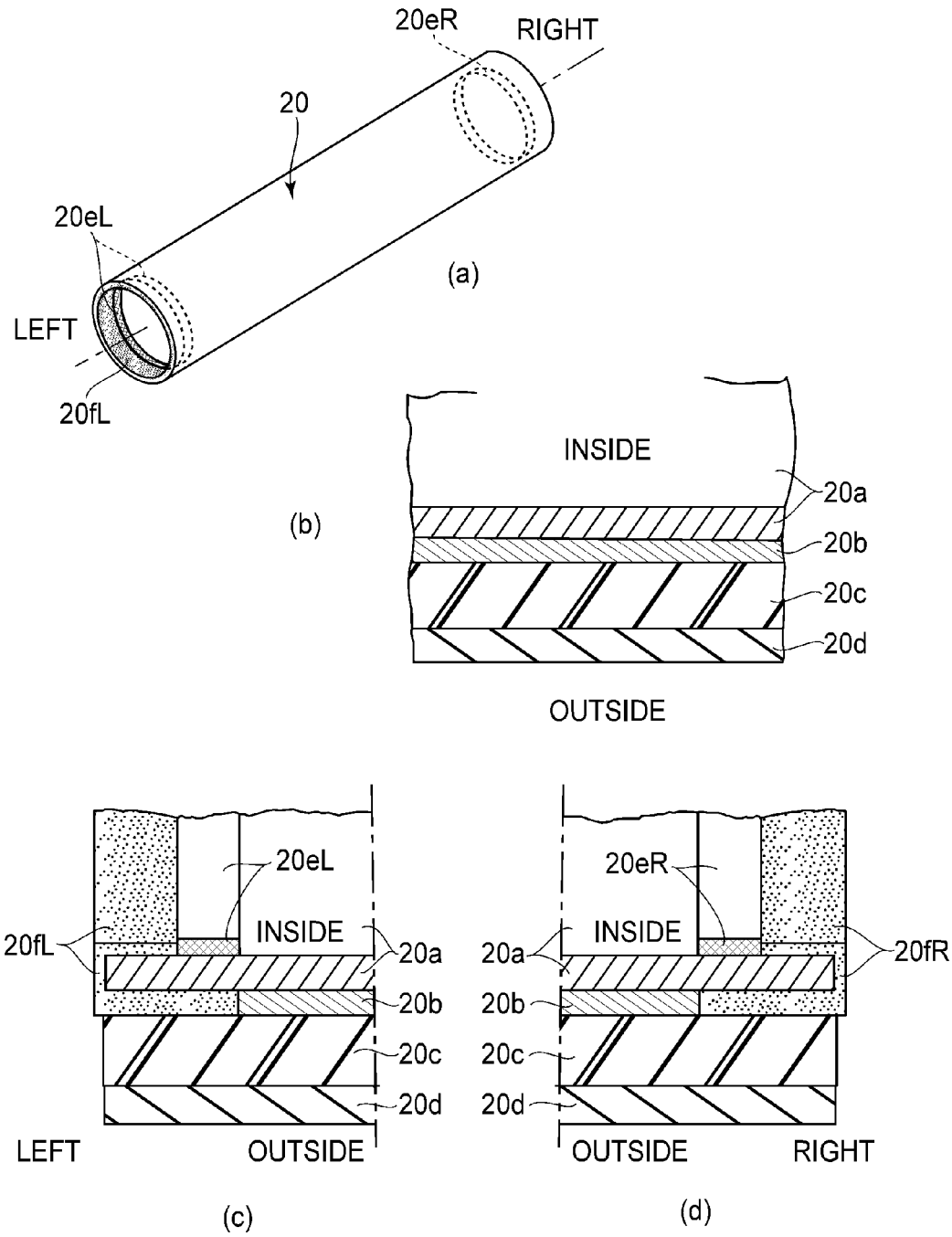
FIG. 5 is a perspective view of the belt of the fixing device in the first embodiment, and shows the structure of the belt.

Next, the structure of the belt 20 is described with reference to FIGS. 5(*a*)-5(*d*). FIG. 5(*a*) is an external perspective view of the belt 20, and FIG. 5(*b*) is a schematic sectional view of the belt 20, at a vertical plane perpendicular to the center portion of the belt 20 in terms of the direction perpendicular to the recording medium conveyance direction a, and shows the laminar structure of the belt 20. FIGS. 5(*c*) and 5(*d*) are schematic sectional views of the left and right end portion of the belt 20, respectively, and show the laminar structure of the lengthwise end portions of the belt 20. Basically, the belt 20 in this embodiment is a laminar belt having four layers, that is, a substrate layer 20*a*, a heat generation layer 20*b*, an elastic layer 20*c*, and a parting layer 20*d*, listing from the inward side of the belt 20. It is flexible, and small in thermal capacity.

As the material for the substrate layer 20*a*, a heat resistant substance, for example, polyimide, polyimide-amide, PEEK, PTFE, PFA, FEP or the like resin, can be used. From the standpoint of providing the belt 20 with a certain amount of rigidity, SUS, nickel, or the like metallic substance can be used as the material for the substrate layer 20*a*. For the purpose of enabling the fixing device 9 to start up quickly, the substrate layer 20*a* needs to be small in thermal capacity. Thus, it is desired to be no more than 50 μm in thickness. However, from the standpoint of strength, it is desired to be no less than 20 μm in thickness. In this embodiment, a cylindrical polyimide belt, which is 30 μm in thickness and 25 mm in diameter, was used as the substrate layer 20*a*. Incidentally, in a case where an electrically conductive substance is used as the material for the substrate layer 20*a*, it is desired that an electrically insulating layer formed of polyimide or the like is provided between the substrate layer 20*a* and heat generation layer 20*b*.

The heat generation layer 20*b* is formed of a heat generating resistor, which is made by dispersing carbon particles (as electrically conductive particles) in polyimide resin. It is formed on the peripheral surface of the substrate layer 20*a* by uniformly coating the substrate layer 20*a* with the heat generating resistor to a thickness of roughly 10 μm. The value of the overall electrical resistance of the heat generation layer 20*b* is 10.0Ω. Therefore, the amount by which electric power is consumed by the heat generation layer 20*b* (amount by which heat is generated by heat generation layer 20*b*) when 100 V of commercial alternating voltage is applied to the heat generation layer 20*b* is 1,000 W. The value for the electrical resistance of the heat generation layer 20*b* has only to be set according to the amount of heat required of the fixing device 9, the amount of voltage to be applied to the fixing device 9, or the like factor. It can be adjusted by adjusting the ratio between the carbon particles and polyimide resin.

The elastic layer 20*c* is 300 μm in thickness. As for the material for the elastic layer 20*c*, silicon rubber which is 10 degree in hardness (JIS-A) and 1.3 W/m·K in thermal conductivity was used. As the material for the parting layer 20*d*, a piece of PFA tube which is 20 μm in thickness was used. The parting layer 20*d* may be formed by coating the elastic layer 20*c* with PFA. The method of forming the parting layer 20*d* with the use of a piece of PFA tube and the method of forming the parting layer 20*d* by coating the elastic layer 20*d* with PFA resin can be selectively used according to the thickness, mechanical and electrical strength which are required of the parting layer 20*d*. Incidentally, in this embodiment, the parting layer 20*d* was adhered to the elastic layer 20*c* with the use of an adhesive made of silicone resin.

Referring to FIG. 4, designated by a reference code W20 is the width (belt width) of the belt 20, that is, the dimension of the belt 20 in terms of the direction X. The belt width W20 is greater than the width of the path Wmax of the widest sheet of the recording medium conveyable through the fixing device 9, in terms of the direction perpendicular to the recording medium conveyance direction, and designated by a reference code W20*b* is the dimension of the heat generation layer 20*b* (heat generation range of heat generation layer), which is greater than the width, in terms of the direction perpendicular to the recording medium conveyance direction a, of the path Wmax of the widest sheet of the recording medium conveyable through the fixing device 9, and is less than the belt width W20. Designated by a reference code WN is the dimension of the nip N in terms of the direction X in FIG. 4, which is equal to the dimension of the elastic layer 22*b* of the pressure roller 22 in terms of the lengthwise direction of the fixing device 9. This dimension WN of the nip N is greater than the dimension W22*b* of the heat generation layer 20*b*, and is less than the belt width W20.

In this embodiment, in order to ensure that the toner is reliably fixed even across the left and right edge portions of the widest sheet of the recording medium, the fixing device 9 is structured so that, in terms of the direction perpendicular to the recording medium conveyance direction a, the left and right end portions of the heat generation layer 20*b* extend by 10 mm beyond the path Wmax of the widest sheet of the recording medium, in terms of direction perpendicular to the recording medium conveyance direction a.

The left and right end portions of the substrate layer 20*a* are fitted with the first and second power supply electrodes 20*e*L and 20*e*R, which are ring-shaped and are in contact with the inward surface of the substrate layer 20*a*. The material for the power supply electrodes 20*e*L and 20*e*R is an electrically conductive substance which contains silver/palladium.

The first and second power supply electrodes 20*e*L and 20*e*R are in contact with the left and right ends of the heat generation layer 20*b*, which is on the peripheral surface of the substrate layer 20*a*, through the electrically conductive coated layers 20*f*L and 20*f*R on the left and right edge portions of the substrate layer 20*a*. Thus, as voltage is applied between the first and second power supply electrodes 20*b*L and 20*b*R, the entirety of the heat generation layer 20*b* generates heat, whereby the entirety of the heating range of the belt 20 is heated by the heat generation layer 20*b*.

As described above, the belt 20 is a laminar belt, having at least the substrate layer 20*a*, the heat generating resistor layer 20*b*, and the parting layer 20*c*, listing from the inward side of the belt 20. It has also: the first and second power supply electrodes 20*e*L and 20*e*R and the first and second electrically conductive coated layers 20*f*L and 20*f*R, as the power supplying portions for providing electrical connection between the electrical power supplying portion 102 (electrical power source), which will be described later, and the heat generating resistor layer 20*b*.

The belt backing member 23 which functions as a pressure pad is in the form of a trough which is roughly semicircular in cross section. It is rigid, heat resistant, and thermally nonconductive. It extends in the left-and-right direction. It supports the belt 20 from within the loop which the belt 20 forms. Further, it guides the belt 20 as the belt 20 is circularly moved. Moreover, it functions as the member for pressing the belt 20 upon the pressure roller 22.

From the standpoint of energy conservation, the material for the belt backing member 23 is desired to be a substance which is small in the amount of thermal conduction between itself and belt backing member supporting stay 24. For example, it is desired to be heat resistant glass, or heat resistant resin such as poly-carbonate, liquid polymer, or the like. In this embodiment, the belt backing member 23 is provided with the electrically conductive portions to supply the heat generation layer 20*b* with the electric power from the electrical power source 102. Therefore, it is mandatory that the material for the belt backing member 23 is electrically insulating. In this embodiment, the material for the belt backing member 23 is Sumikasuper E5204L (product of Sumitomo Chemistry Co., Ltd.).

Figure 6:
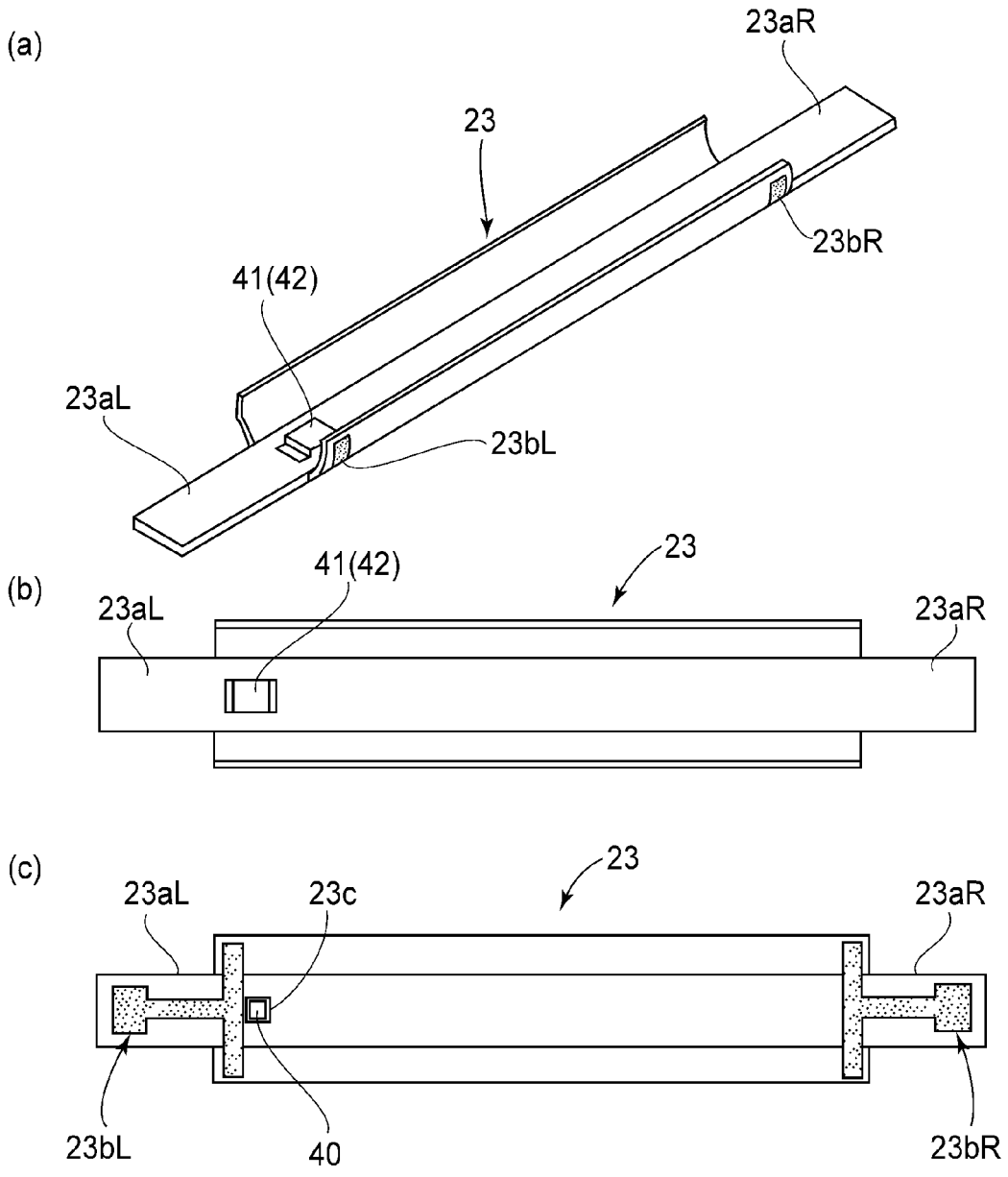
FIG. 6 is a drawing for describing the structure of the belt backing member of the fixing device in the first embodiment.

FIG. 6(*a*) is an external perspective view of the belt backing member 23. FIGS. 6(*b*) and 6(*c*) are the top and bottom plan views, respectively, of the belt backing member 23. The belt backing member 23 has left and right arms 23*a*L and 23*a*R, which extend outward beyond the left and right openings of the belt 20, respectively. The left and right arms 23*a*L and 23*a*R are provided with the first and second electrically conductive portions 23*b*L and 23*b*R, which are on the bottom surfaces of the left and right arms 23*a*L and 23*a*R.

The first and second electrically conductive portions 23*b*L and 23*b*R are the portions of the belt backing member 23, which face the first and second power supply electrode portions 20*e*L and 20*e*R, respectively, which are on the inward side of the loop which the belt 20 forms. They are long enough, in terms of the widthwise direction the belt 20, to extend into the area across which the belt backing member 23 presses the pressure roller 22, that is, the fixation nip N, with the presence of the belt 20 between itself and pressure roller 22.

The portion of the belt backing member 23, which corresponds in position to the base side of the left arm 23*a*L, is provided with a through hole 23*c* (perpendicular to top and bottom surface of belt backing member 23), through which safety elements such as a thermo-switch, a temperature fuse, or the like are put.

3) Belt Backing Member Supporting Stay 24

The belt backing member supporting stay 24 (which hereafter may be referred to simply as support stay 24) is a rigid member, and extends in the left-and-right direction of the fixing device 9. It is U-shaped in cross section, and is placed in such an attitude that its opening faces downward. It is placed within the belt backing member 23 to support the belt backing member 23. The material for the support stay 24 is desired to be such a substance that is unlikely to bend even if it is subjected to a large amount of pressure. In this embodiment, SUS 304 was used as the material for the support stay 24. The belt backing member supporting stay 24 has arms 24*a*L and 24*a*R, which extend outward of the belt 20 through the left and right openings of the belt 20, respectively. The arms 24*a*L and 24*a*R are positioned above the left and right arms 23*a*L and 23*a*R of the belt backing member 23, respectively.

4) Flanges 25L and 25R

Figure 7:
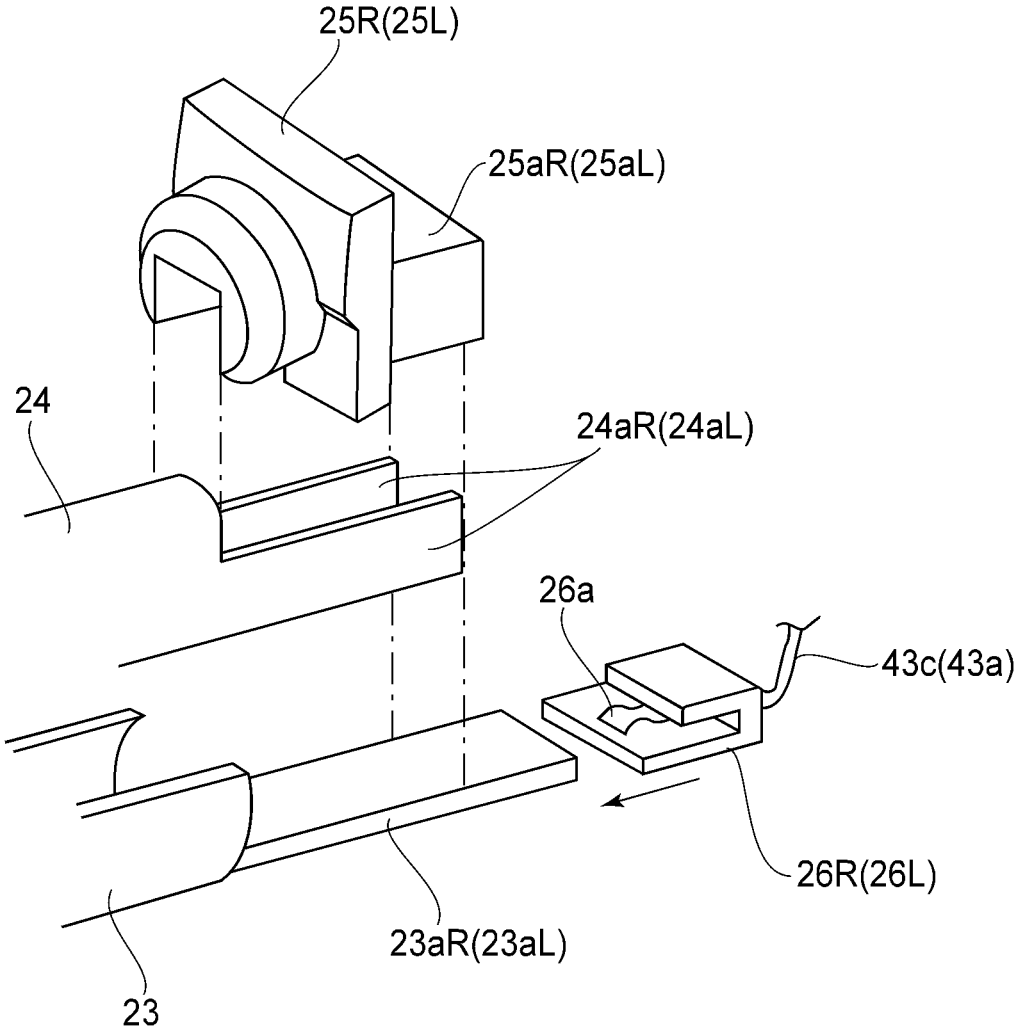
FIG. 7 is an exploded perspective view of one of the lengthwise end portions of the belt unit of the fixing device in the first embodiment.

The flanges 25L and 25R are symmetrical to each other in shape, and are symmetrically positioned with reference to the center of the fixing device 9 in terms of the lengthwise direction of the fixing device 9. They are solidly attached to the left and right arms 24*a*L and 24*a*R, respectively. FIG. 7 is an exploded perspective view of the right end portion of the belt backing member 23, and shows the right flange 25R, right arm 24*a*R of the support stay 24, and right arm 23*a*R of the belt backing member 23, and right power supply connector 26R (which will be described later). The left end portion of the belt backing member 23 and the left end portion of the support stay 24 are the same in structure as the right counterparts shown in FIG. 7. The belt 20 is loosely fitted around the combination of the belt backing member 23 and support stay 24, between the left and right flanges 25L and 25R.

5) Mechanism for Moving Belt Backing Member

The belt unit 21 consisting of the belt backing member 23, support stay 24, belt 20, left flange 25L, and right flange 25R. It is positioned between the left and right lateral plates 30L and 30R, in parallel to the pressure roller 22, in such an attitude that the belt backing member 23 is under the support stay 24. The left and right flanges 25L and 25R are in engagement with the left and right lateral plates 30L and 30R of the frame of the fixing device 9. More specifically, the left and right flanges 25L and 25R are provided with a vertical groove (unshown), and the left and right lateral plate 30L and 30R are provided with vertical slits 30*a*L and 30*a*R, respectively. Further, the vertical grooves (unshown) of the left and right flanges 25L and 25R are in engagement with the vertical edge portions of the vertical slits 30*a*L and 30*a*R of the lateral plate 30L and 30R of the flanges 25L and 25R, respectively. Therefore, the belt unit 21 is vertically movable (slidable) between the left and right lateral plates 30L and 30R of the frame of the fixing device 9.

Designated by reference codes 27L and 27R are left and right mechanisms for moving (shifting) the belt backing member 23, which are on the outward side of the left and right lateral plates 30L and 30R of the frame of the fixing device 9. The belt backing member moving (shifting) mechanism in this embodiment is a combination of a solenoid switch and a plunger. More specifically, the plunger 27*a*L of the left mechanism (device) 27L for moving (shifting) the belt backing member 23 is attached to the outward extension 25*a*L of the left flange 25L, and the plunger 27*a*R of the right mechanism 27R for moving (shifting) the belt backing member 23 is solidly attached to the outward extension 25*a*R of the right flange 25R. The left and right mechanisms (devices) 27L and 27R are turned on or off by the control circuit 100.

In this embodiment, when the left and right mechanisms (devices) 27L and 27R are off, their plungers 27*a*L and 27*a*R are kept at their bottom positions by the compression springs (unshown) in the fixing device 9. The pressure applied to the plungers 27*a*L and 27*a*R by the compression springs acts on (presses) the belt backing member 23 through the left and right flanges 25L and 25R and belt backing member 23.

Therefore, the downwardly facing surface of the belt backing member 23 applies a preset amount of pressure to the upwardly facing surface of the pressure roller 22 against the elasticity of the elastic layer 2*b* of the pressure roller 22. In this embodiment, the amount of pressure applied by the aforementioned compression springs per lengthwise end of the pressure roller 22 is 156.8 N; the total amount of pressure applied to the pressure roller 22 is 313.6 N (32 kgf). Thus, the fixation nip N, which has a preset width in terms of the recording medium conveyance direction a, is formed between the belt 20 and pressure roller 22. Further, the first and second power supply electrodes 20*e*L and 20*e*R of the belt 20 are in contact with the first and second electrically conductive portions 23*b*L and 23*b*R of the belt backing member 23, establishing thereby electrical connection between the electrodes 20*e*L and 20*e*R and first and second electrically conductive portions 23*b*L and 23*b*R, at the left and right ends of the nip N.

On the other hand, as the left and right mechanism (devices) 27L and 27R for moving the belt backing member 23 are turned on, the plungers 27*a*L and 27*a*R are lifted into their top positions against the compression springs in the fixing device 9, and kept in the top positions. Thus, the pressure being applied to the pressure roller 22 by the belt backing member 23 is removed, and the belt backing member 23 is moved away from the pressure roller 22. That is, as long as the left and right mechanism (devices) 27L and 27R for moving the belt backing member 23 are kept turned on, the belt 20 is kept separated from the pressure roller 22.

In the case of the fixing device 9 in this embodiment, even while the belt 20 is kept separated from the pressure roller 22, the first and second power supply electrodes 20*e*L and 20*e*R of the belt 20 are kept in contact with the first and second electrically conductive portions 23*b*L and 23*b*R of the belt backing member 23 to maintain the electrical connection between the first and second power supply electrodes 20*e*L and 20*e*R of the belt 20, and the first and second electrically conductive portions 23*b*L and 23*b*R of the belt backing member 23, in order to keep on supplying the heat generation layer 20*b* with electric power.

In this embodiment, the combination of the solenoid and plunger was used as the left and right mechanism (devices) 27L and 27R as the mechanism for placing the belt 20 in contact with, or separating the belt 20 from, the pressure roller 22. However, the application of the present invention is not limited to a fixing device, whose mechanism (devices) for moving the belt backing member 23 is a combination of a solenoid switch and a plunger. That is, the present invention is applicable to a fixing device, the mechanism of which for vertically moving the belt backing member 23 is not a combination of a solenoid and a plunger, as long as the mechanism can vertically move the belt backing member 23 as described above. For example, the present invention is applicable to a fixing apparatus (device) whose mechanism for moving the belt backing member 23 is a combination of a pressure application arm, a compression spring, and a cam, a combination of a rack and a pinion gear, or the like.

6) Power Supply System for Heat Generation Layer 20*b* of Belt 20

The left and right arms 23*a*L and 23*a*R of the belt backing member 23 are fitted with power supply connectors 26L and 26R, respectively. Thus, the electrode portion 26*a* (FIG. 7) of the left connector 26L is pressed upon the first power supply electrode 20*e*L, enabling electric current to flow between the electrode portion 26*a* and first power supply electrode 20*e*L, and the electrode portion 26*a* of the right connector 26R is pressed upon the second power supply electrode 20*e*R, enabling electric current to flow between the electrode portion 26*a* and the second power supply electrode 20*e*R.

The vertical through hole 23*c* of the belt backing member 23 is fitted with the safety element 40. The safety element (current blocking element, thermal fuse) used in this embodiment is a thermo-switch CH-16 (product of Wako Electronics Co., Ltd.). Hereafter, the safety element 40 will be referred to as the thermo-switch 40. It is the belt backing member 23 that is fitted with the thermo-switch 40; the thermo-switch 40 is inserted into the vertical through hole (opening) 23*c* of the belt backing member 23, from the inward side of the belt backing member 23, in such a manner that its heat sensitive portion is exposed on the belt side of the belt backing member 23.

Thus, the thermo-switch 40 is kept pressed downward by the resiliency of the compression springs (pressure applying members) 42 installed compressed between the spring holder 41 (which is on the inward side of the belt backing member 23, and the top end of the thermo-switch 40. Therefore, the heat sensitive portion of the thermo-switch 40 is kept pressed upon the inward surface of the belt 20. That is, the fixing device 9 is structured so that the thermo-switch 40 is attached to the belt backing member 23 which is the pressure applying member for keeping the belt 20 pressed in the preset direction, as described above. Therefore, it is ensured that the thermo-switch 40 remains in contact with the belt 20.

One of the two electrical terminals of the thermo-switch 40 is in electrical connection to the electrical terminal 26*a* of the left connector 26L through an electrical wire 43*a*. The other electrical terminal of the thermo-switch 40 is in electrical connection to the electrical power source (commercial power source) 102 through an electrical wire 43*b*. Further, the electrical terminal 26*a* of the right connector 26R is in electrical connection to the power supply source 102 through an electrical wire 43*c*. The amount of electrical power supplied from the power supply source 102 to the heat generation layer 20*b* is controlled by a triac 101, which is under the control of the control circuit 100.

Therefore, an electrical power supply circuit, through which electric power is transmitted from the electric power source 102 to the heat generation layer 20*b* through wire 42*b* R thermo-switch 40 R electrical terminal of left connector 26LR first electrically conductive portion 23*b*L R first electrical power supply electrode 20*e*L R electrically conductive coated layer 20*f*L, is formed. Further, another electrical power supply circuit is formed between the heat generation layer 20*b* and electrical power source 102: heat generation layer 20*b* R electrically conductive coated layer 20*f*R R second power supply electrode 20*e*R R electrode 26*a* of right connector 26R R electrical wire 42*c* R electrical power source 102.

Thus, as electric power is supplied from the electrical power source 102 to the heat generation layer 20*b* of the belt 20 through the above described electrical power transmission circuit, the heat generation layer 20*b* of the belt 20 generates heat across its entire range in terms of both the circumferential direction and widthwise direction of the belt 20. Therefore, virtually the entirety of the belt 20 is heated.

As the temperature of the belt 20 reaches a preset level (upper limit), the thermo-switch 40 interrupts the electrical connection between the heat generating resistor layer 20*b* and electrical power source 102. That is, the thermo-switch 40 is an electrical element for blocking the electrical power supply circuit through which electrical power is supplied to the heat generation layer 20*b*. In terms of the widthwise direction of the belt 20, the thermo-switch 40 is kept in contact with the belt 20, at a position B which is within the heat generation range W22*b* of the heat generation resistor layer 20*b* of the belt 20, and outside the path Wmax of the widest sheet of the recording medium properly conveyable through the fixing device 9.

Referring to FIG. 2, designated by a reference code TH is a thermistor as a temperature sensor for detecting the temperature of the belt 20. In this embodiment, the thermistor TH is supported by the frame 30 of the fixing device 9, in the adjacencies of the outward surface of the belt 20; there is no contact between the thermistor TH and belt 20. It plays the role of detecting the surface temperature of the belt 20 without contacting the surface of the belt 20. The thermistor TH is for detecting the temperature of the portion of the belt 20, which remains within the recording medium path, in terms of the direction perpendicular to the recording medium conveyance direction a, even when the narrowest sheet of the recording medium is conveyed through the fixing device 9. Therefore, it is positioned in the adjacencies of the outward surface of the belt 20, with no contact between itself and belt 20, so that, in terms of the direction perpendicular to the recording medium conveyance direction a, its position corresponds to the centerline O (recording medium conveyance reference line) of the recording medium passage of the fixing device 9.

The thermistor TH is in connection to the control circuit (controller) 100 through an A/D converter 103. The controller 100 samples the output of the thermistor TH with a preset frequency, and reflects the obtained temperature information upon the controlling of the amount by which electrical current is supplied to the heat generation layer 20*b* of the belt 20. That is, the control circuit 100 sets the amount of current to be supplied to the heat generation layer 20*b* of the belt 20, based on the output of the thermistor TH, and controls the amount by which current is supplied to the heat generation layer 20*b* from the electrical power source 102. In other words, in the case of the fixing device 9 in this embodiment, the control circuit 100 controls the amount of current supplied to the heat generation layer 20*b*, based on the temperature level for fixing a toner image t to a sheet P of the recording medium, in such a manner that the temperature of the belt 20 detected by the thermistor TH remains stable at 160° C., which is the temperature level at which the toner image t is to be heated.

If the belt 20 happens to abnormally increase in temperature for some reason or other, that is, the control circuit 100 determines, based on the information it receives from the thermistor TH, that the belt 20 is abnormally high in temperature, the control circuit 100 stops supplying the heat generation layer 20*b* with electric power. Further, in this embodiment, the fixing device 9 is provided with the thermo-switch 40. Therefore, even if the control circuit 100 gets out of order, the belt 20 is prevented by the thermo-switch 40 from continuing to excessively increasing in temperature. That is, the fixing device 9 in this embodiment is provided with double layers of safety measure.

7) Operational Sequence of Fixing Device

Figure 9:
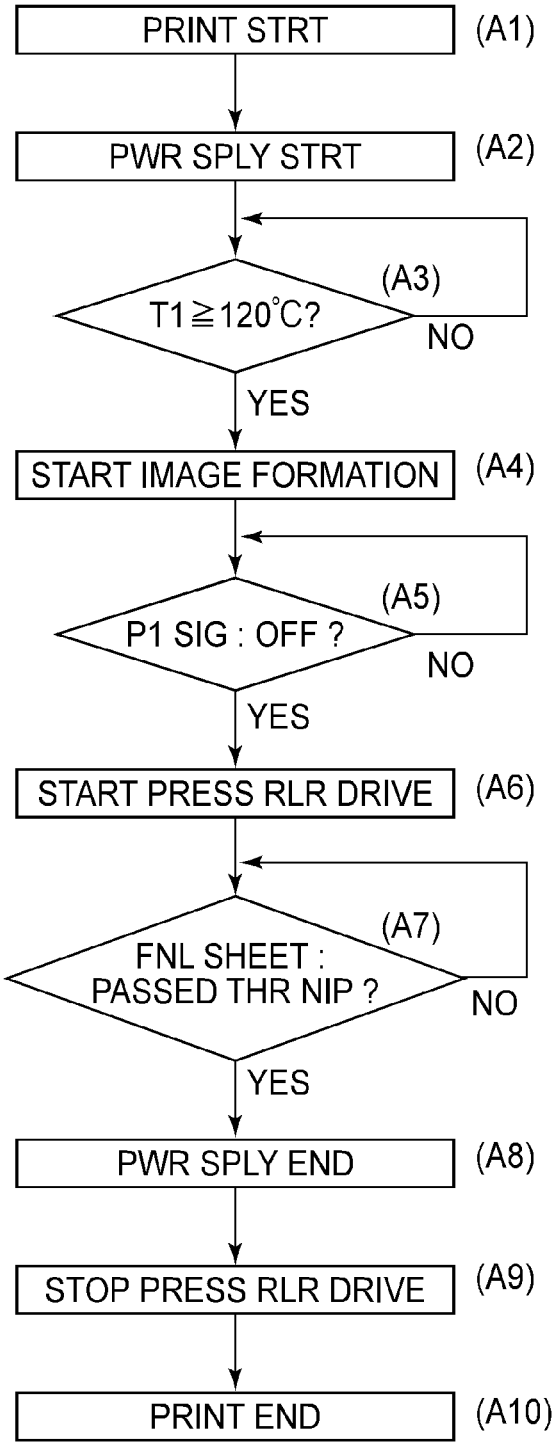
FIG. 9 is the flowchart of the fixing device in the first embodiment.

Next, referring to FIG. 9, the operational flow of the fixing device 9 in this embodiment is described. While the fixing device 9 is kept on standby, the fixation motor M is kept turned off. Therefore, the pressure roller 22 remains stationary. Further, the power supply 102 is kept turned off. Thus, the belt 20 is not heated. Further, the left and right mechanisms (devices) 27L and 27R for moving the belt backing member 23 are not supplied with electrical current. Thus, the belt unit 21 is kept pressed against the pressure roller 22.

As the control circuit 100 receives a print start command from a user through the control panel of the image forming apparatus, or from the input device of the host apparatus 200 such as a personal computer while the fixing device 9 is in the above described state, the control circuit 100 makes the image formation station(s) start an image forming operation (Step A1).

Regarding the fixing device 9, the control circuit 100 turns on the electrical power source 102 to start supplying electrical power to the heat generation layer 20*b* of the belt 20 through the aforementioned power supply system (Step A2). At this point in time, the motor M is still kept turned off, and therefore, the pressure roller 22 is not rotated, and therefore, the belt 20 remains stationary.

While the fixing device 9 is in the above described state, as the belt 20 is heated and the temperature of the belt 20 detected by the thermistor TH reaches the preset level (120° in this embodiment) (Step S3), the formation of a toner image on the photosensitive drum 3 in the image formation station(s) is started (Step A4). Then, a sheet P of the recording medium on which an unfixed toner image t is borne, is conveyed to the fixing device 9. The control circuit 100 turns on the motor M with such timing that the sheet P reaches a point which is 20 mm from the fixation nip N (Step A5). In other words, the pressure roller 22 begins to be rotated in the counterclockwise direction indicated by an arrow mark R22 in FIG. 2, at a preset peripheral velocity (Step A6).

The timing with which the pressure roller 22 begins to be driven is the same as the timing with which the photo interrupter P1 is turned off (its output signals is blocked) because a recording medium detection flag F of the entrance guide 44 of the fixing device 9 is moved by the pressure from the sheet P. The temperature of the belt 20 detected by the thermistor TH at this point in time is 160° C., which is the same as the target temperature level of the belt 20 (image heating temperature level).

As the pressure roller 22 begins to rotate, rotational force is transmitted from the pressure roller 22 to the belt 20 by the friction between the peripheral surface of the pressure roller 22 and the outward surface of the belt 20, in the nip N. Thus, the belt 20 circularly moves around the combination of the belt backing member 23 and support stay 24 in the clockwise direction indicated by an arrow mark R20, with the inwardly facing surface of the belt 20 sliding on the downwardly facing surface of the belt backing member 23, at roughly the same speed as the peripheral velocity of the pressure roller 22.

As the belt 20 is circularly moved, the belt backing member 23 guides the belt 20. Further, the leftward or rightward deviation of the belt 20 with reference to the lengthwise direction of the belt backing member 23, which tends to occur as the belt 20 is circularly moved, is controlled by the left and right flanges 25L and 25R, respectively. The inward surface of the belt 20 is coated with grease (lubricant), which bears the role of minimizing the amount of the wear of the inward surface of the belt 20, which is attributable to the friction between the downwardly facing surface of the belt backing member 23 and the inward surface of the belt 20.

A sheet P of the recording medium, on which an unfixed toner image t is borne, is guided into the nip N by the guide 44, and is conveyed through the nip N while remaining pinched by the belt 20 and pressure roller 22. That is, the sheet P moves with the belt 20 through the nip N, with its image bearing surface remaining in contact with the outward surface of the belt 20. While the sheet P is conveyed through the nip N, the heat generated in the heat generation layer 20*b* of the belt 20 is given to the sheet P, whereby the unfixed toner image t on the sheet P is melted, and becomes fixed to the sheet P. As the sheet P is conveyed out of the nip N, it is separated by the curvature of the belt 20 (belt backing member 23), and is discharged from the fixing device 9 by the pair of discharge rollers 45 of the fixing device 9.

The control circuit 100 counts the number of the subsequent sheets P of the recording medium with the use of the combination of the sheet detection flag F and photo-interrupter P1. As soon as a sheet P of the recording medium is detected in the single print mode by the combination of the sheet detection flag F and photo-interrupter P1, or the last sheet P of the recording medium in the continuous printing mode, in which a preset number of prints are to be outputted, is counted by the combination, the control circuit 100 calculates the length of time it takes for the trailing edge of the last sheet P to be moved through the nip N, based on the point in time at which the leading edge of the last sheet P is detected by the combination, speed at which the last sheet P is being conveyed, and the measurement of the last sheet P in terms of the recording medium conveyance direction.

As soon as the control circuit 100 determines, based on the above described calculation, the point in time at which the single sheet P of the recording medium in the single printing mode, or the last sheet P of the recording medium in the continuous printing mode, comes out of the nip N (Step A7), it quickly stop supplying the heat generation layer 20*b* with electrical current (Step A8). Thereafter, it turns off the motor M to stop rotating the pressure roller 22 (Step A9), ending thereby the printing operation (Step A10).

In this connection, the fixing device 9 may be structured so that the sheet P of the recording medium in the single print mode, or the last sheet P in the continuous printing mode, that is, the printing mode in which a preset number of sheets P of recording prints are continuous conveyed, is detected by positioning a sheet sensor at the sheet exit of the nip N.

As described above, the fixing device 9 in this embodiment is structured so that during the warm-up period in which the heat generation layer 20*b* of the belt 20 is supplied with electric current to heat the belt 20 until the belt temperature reaches the preset temperature level (fixation temperature), the belt 20 is not rotated. That is, the fixing device 9 is structured so that the belt 20 is heated, without being circularly moved, until the temperature level detected by the thermistor TH reaches 160° C., which is the image heating temperature level, and immediately before the first sheet (or only sheet) of the recording medium in an image forming operation reaches the nip N. Therefore, the length of time it takes for the temperature of the belt 20 to reach its target level from when it begins to be heated, that is, the warm-up time, is roughly 6 seconds. In other words, the fixing device 9 is very short in warm-up time.

Figure 10:
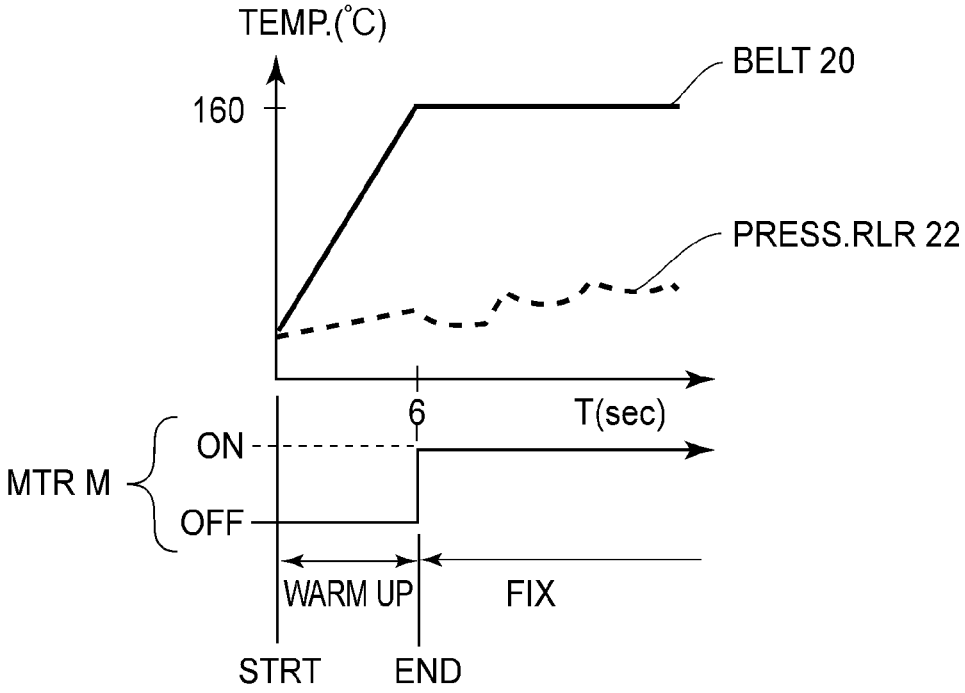
FIG. 10 is a drawing for showing the changes in the temperature of the fixation belt and pressure roller of the fixing device in the first embodiment, which occur during the period between the starting of the warming up of the fixation belt and pressure roller, and the starting of the fixation, and those which occur during the period thereafter.
Figure 11:
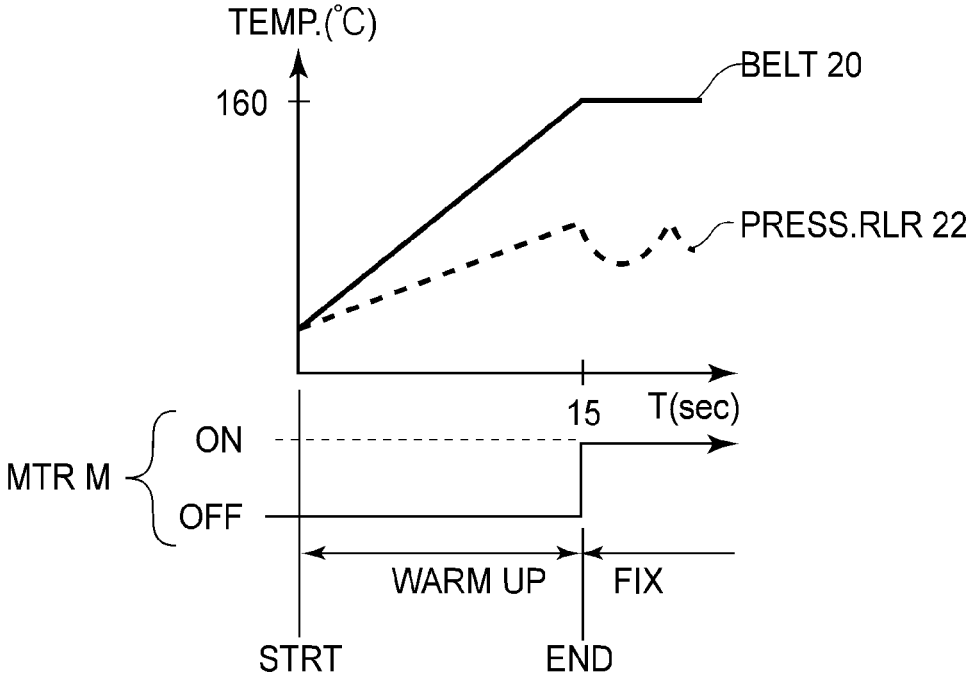
FIG. 11 is a drawing for showing the changes in the temperature of the fixation belt and pressure roller of a comparative fixing device, which occur during the period between the starting of the warming up of the fixation belt and pressure roller, and the starting of the fixation, and those that occur during the period thereafter.

FIG. 10 shows the changes in the temperature of the belt 20 and the pressure roller 22 of the fixing device 9 in this embodiment, which occur during the period in which the fixing device 9 is warmed up (started up), and also, during the actual fixing operation. In comparison, FIG. 11 shows the changes in the temperature of the belt 20 and pressure roller 22 of a comparative fixing device (9), which occurs during the period in which the fixing device (9) is warmed up (started up), and also, the during the actual fixing operation. In the case of the comparative fixing device (9), the pressure roller (22) is continuously rotated even while the belt (20) is warmed up. In FIGS. 10 and 11, the solid lines represent the changes in the temperature of the fixation belt, and the broken lines represent the changes in the temperature of the pressure roller.

In the case of the fixing device 9 in this embodiment, the pressure roller 22 is not rotated during the warm-up period. Therefore, it is difficult for heat to transfer from the belt 20 to the pressure roller 22. Thus, the pressure roller 22 hardly increases in temperature during the warm-up period. That is, almost the entirety of the heat generated in the heat generation layer 20*b* is used for heating the belt 20. Therefore, it takes a significantly shorter length of time to warm up the belt 20 (to startup fixing device 9) in this embodiment than the belt (20) of the comparative fixing device (9). That is, the fixing device 9 in this embodiment is structured so that during the warm-up period, the belt 20 is heated without being driven. Therefore, not only is the fixing device 9 in this embodiment shorter in warm-up time, but also, longer in service life, than the comparative fixing device.

It takes about six seconds for the fixing device 9 (FIG. 10) in this embodiment to warm up. In the case of the comparative fixing device (FIG. 11), the pressure roller 22 is rotated while the fixing device is warmed up, that is, the belt is circularly moved. Therefore, the comparative fixing device is greater in the amount of heat transferred from the belt to the pressure roller during the warm-up period, being therefore greater in the amount the pressure roller 22 increases in temperature. Thus, the length of time it takes to increase the temperature of the belt to the target level, or the fixation level, that is, the length of time necessary to warm up the fixing device, is about 15 seconds.

In addition, in the case of the fixing device 9 in this embodiment, its belt is not circularly moved, that is, the pressure roller 22 is not rotated, while it is warmed up. Therefore, it is smaller in the amount of minute particles and the like attributable to the frictional wear of the inward surface of the belt 20 and belt backing member 23, being therefore smaller in the amount of torque necessary to drive the device, than the comparative fixing device.

Next, referring to FIG. 4, the positional relationship, in terms of the widthwise direction of the belt 20 (X direction in FIG. 4), among the thermo-switch (safety element) 40, thermistor TH, and heat generation layer 20*b* of the belt 20 is described. The thermo-switch 40 is serially connected between the electrical power source 102 (which functions as the device for supplying the heat generation layer 20*b* of the belt 20 with electric power) and the heat generation layer 20*b*.

Therefore, if the belt 20 abnormally increases in temperature because of the malfunctioning of the control circuit (CPU) 100, temperature detecting means, etc., the internal bimetal of the thermo-switch 40 interrupts the power supply to the heat generation layer 20*b* by melting. In the case of the thermo-switch 40 in this embodiment, as the temperature of its heat sensitive portion reaches 220° C., its internal bimetal breaks the electrical connection between its electrodes by melting.

It is desired that the thermo-switch 40 is placed in such a position that ensure that the thermo-switch 40 detects the abnormal increase in the temperature of the belt 20. More specifically, it is desired that the heat sensitive portion of the thermo-switch 40 is placed in contact with the belt 20, within the heat generation range W22*b* of the belt 20 in terms of the widthwise direction of the belt 20. This positioning of the thermo-switch 40 is for ensuring that the thermo-switch 40 quickly responds to the abnormal increase in the temperature of the belt 20, and interrupts the power supply to the heat generation layer 20*b*.

Referring to FIG. 4, in the case of the fixing device 9 in this embodiment, the width W20*b* of the heat generation layer 20*b* of the belt 20 is such that the belt 20 extends by 10 mm beyond each of the edges of the path Wmax of the widest sheet P of the recording medium usable with the fixing device 9. Further, in terms of the widthwise direction of the belt 20, the thermo-switch (current blocking element, safety element, safety device) 40 is positioned between the edge of the path Wmax of the widest sheet P of the recording medium properly conveyable through the fixing device 9 and the corresponding edge of the heat generation range W20*b* of the heat generation layer 20*b*, with the heat sensitive portion of the thermo-switch 40 being in contact with the inward surface of the belt 20. The safety element, such as the thermo-switch 40, is characterized in that if electric current flows through an electric circuit by an amount greater than a preset amount, due to some anomaly or the other, it breaks the circuit by being melted by the Joule heat generated by the current which flows through the element.

An expression "to place the thermo-switch 40 outside the path Wmax of the widest sheet of the recording medium conveyable through the fixing device 9" means that, in terms of the direction (Y direction in FIG. 4) perpendicular to the widthwise direction of the belt 20, the thermo-switch 40 is outside the path Wmax of the widest sheet P of the recording medium conveyable through the fixing device 9 as shown in FIG. 4. Further, an expression "placing the thermo-switch 40 on the inward side of the heat generation range W20*b* of the heat generation layer 20*b*" means that, in terms of the direction (Y direction in FIG. 4) perpendicular to the width direction of the belt 20, the thermo-switch 40 is within the heat generation range W20*b* of the heat generation layer 20*b*.

Therefore, the thermo-switch 40 can play the role of blocking the current supply to the heat generation layer 20*b* as the temperature of the belt 20 abnormally increases. Therefore, even if the malfunction of the control circuit 100 and/or temperature detecting means TH, or the like problem, prevents the control circuit 100, temperature detecting means TH, and/or the like, from blocking of the current supply to the heat generation layer 20*b*, the current supply to the heat generation layer 20*b* can be blocked.

Moreover, even though the portion of the belt 20, which is in contact with the heat sensing portion of the thermo-switch 40, remains lower in temperature than the other portions of the belt 20, its position B is outside the path Wmax of the widest sheet P of the recording medium conveyable through the fixing device 9. Therefore, it does not occur that the fixing device 9 outputs a print, the image of which is lower in gloss than a normal print, and/or that the fixing device 9 fails to properly fix an unfixed toner image on a sheet P of the recording medium.

That is, the fixing device 9 in this embodiment is structured so that the thermo-switch 40 or the like safety element (current blocking element) 40, is placed in contact with the belt 20, outside the path of the unfixed toner image, and within the heat generation range of the heat generating resistor layer 20*b*.

Because the fixing device 9 in this embodiment is structured as described above, it can deals with such a situation that the control circuit 100, which controls the voltage applied to the heat generation resistor layer 20*b* fails; the temperature detecting means for detecting the temperature of the belt 20 fails; and/or the like problem occurs. That is, as the temperature of the belt 20 reaches a preset limit (upper limit), the fixing device 9 in this embodiment can break the electrical connection between the heat generating resistor layer 20*b* and electrical power source 102. In other words, it does not uncontrollably increase in temperature. Further, it does not suffer from the problem that the portion of its belt, which is within the path of an unfixed toner image, becomes, and/or remains, lower in temperature across a certain portion. Therefore, it does not outputs a print, the image on which is lower in gloss than the image on a normal print, a print which is unsatisfactory in fixation, and/or the like print.

The thermistor TH in this embodiment is an infrared temperature sensor A2TPMI (product of Perling Elmer, Co., Ltd.). It is widely known that this type of thermistor TH can measure the temperature of an object without being placed in contact with the object, and also, that it is excellent in term of responsiveness.

The current supply to the heat generation layer 20*b* of the fixing device 9 in this embodiment is controlled based on the difference between the temperature of the belt 20 detected by the thermistor TH and the target temperature level for the belt 10, which is 160° C. Therefore, in order to keep the temperature of the belt 20 constant, across its portion within the recording medium path, while the fixing device 9 is in operation, it is obvious that it is desired that the thermistor TH is positioned within the path Wmin of the narrowest sheet of the recording medium. In this embodiment, therefore, the thermistor TH is positioned so that in terms of the widthwise direction of the belt 20, its position coincides with the centerline O of the recording medium passage, and also, so that it is positioned in the adjacencies of the outward surface of the belt 20, with the presence of a preset amount of distance from the outward surface of the belt 20.

Therefore, it is ensured that the thermistor TH in this embodiment can accurately measure the temperature of the portion of the belt 20, which is within the recording medium path, even when the narrowest sheet P of the recording medium is conveyed for fixation through the fixing device 9. Further, since there is no physical contact between the thermistor TH in this embodiment and belt 20, it does not occur that the belt 20 remains lower in temperature across its certain area during the warm-up period.

That is, the fixing device 9 in this embodiment is structured so that the temperature detecting means TH for detecting the temperature of the belt 20 is placed within the path of the narrowest sheet of the recording medium conveyable through the fixing device 9. Therefore, not only can the temperature detecting means TH accurately detect the temperature of the portion of the belt 20 within the recording medium path, regardless of the recording medium size, but also, does not make lower in temperature, the portion of the belt, which corresponds in position to the temperature detecting means TH. Thus, the fixing device 9 in this embodiment does not output a print, the image on which is lower in gloss than the image on a normal print, and/or does not unsatisfactorily fix an unfixed toner image.

As described above, in the case of the fixing device 9 in this embodiment, even though the belt 20 is warmed up while the pressure roller 22 is kept stationary, the problems that occur to a portion or portions of an unfixed toner image, which correspond in position to a portion or portions of the belt 20, which are lower in temperature than the rest, that is, the problem that a part or parts of the fixed toner image are lower in gloss than the rest, and/or the problem that a fixing device fails to satisfactorily fix an unfixed toner image, do not occur.

Embodiment 2

The fixing device 9 in this embodiment is structured so that the belt 20 is kept separated from the pressure roller 22 while it is warmed up. Therefore, it is even shorter in the length of the warm-up time than the fixing device 9 in the first embodiment. Otherwise, this embodiment is the same as the first embodiment, in terms of the structure of the image forming apparatus, structure of the fixing device, positioning of the thermo-switch 40 and thermistor TH, temperature setting, and the like factors. Thus, the fixing device in this embodiment is not described in order not to repeat the same description.

Figure 12:
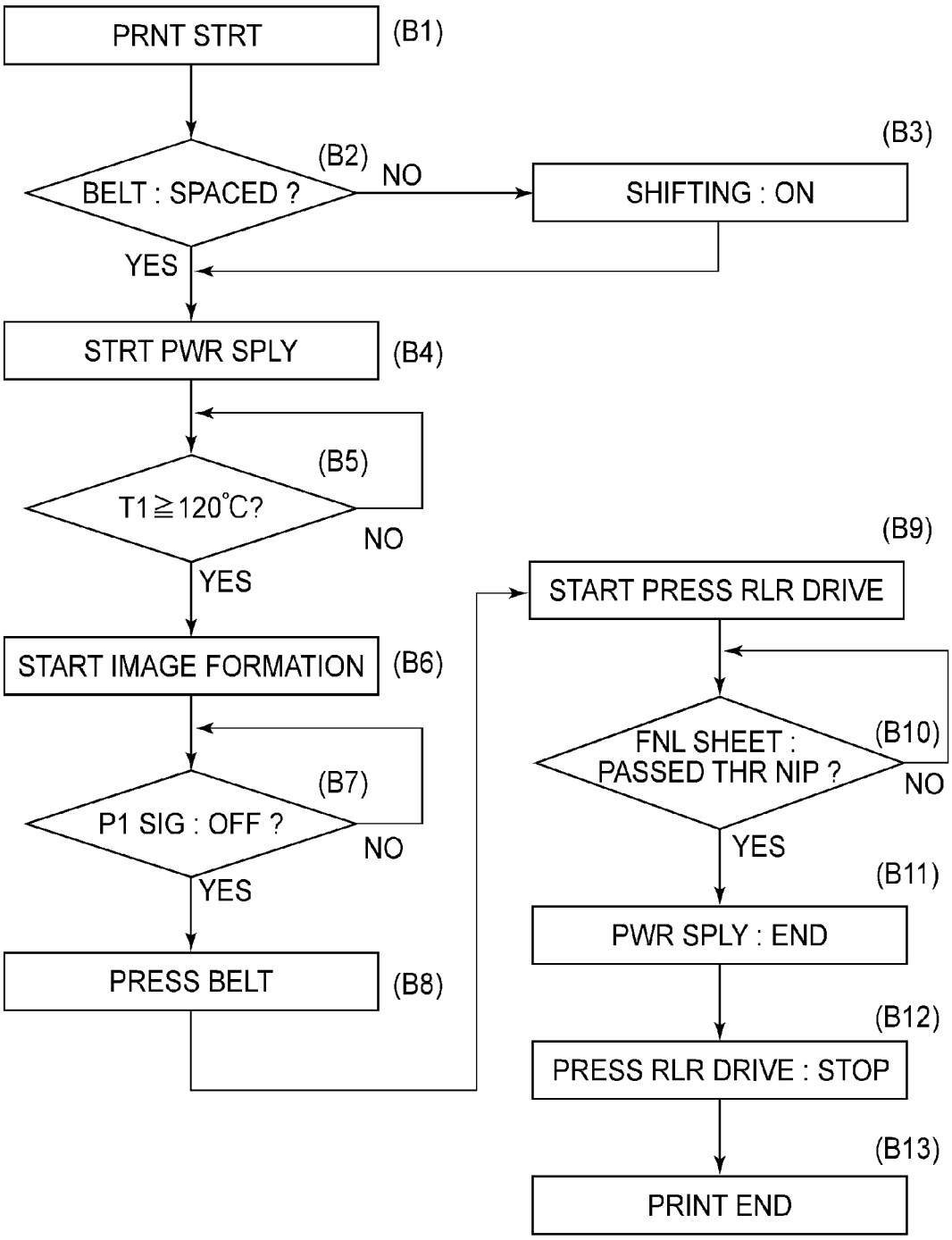
FIG. 12 is a flowchart of the operational sequence of the fixing device in the second embodiment of the present invention.

Next, referring to FIG. 12, the operational sequence of the fixing device 9 in this embodiment is described. While the fixing device 9 is kept on standby, the fixation motor M is kept turned off, and therefore, the pressure roller 22 remains stationary. Further, the electrical power source 102 is kept turned off, and therefore, the belt 20 is not heated. As the control circuit 100 receives a print start command from a user through the control panel 104 of the image forming apparatus, or from the input device of the host apparatus 200 such as a personal computer while the fixing device 9 is in the above described state, the control circuit 100 makes the image formation station(s) start an image forming operation (Step B1).

Figure 8:
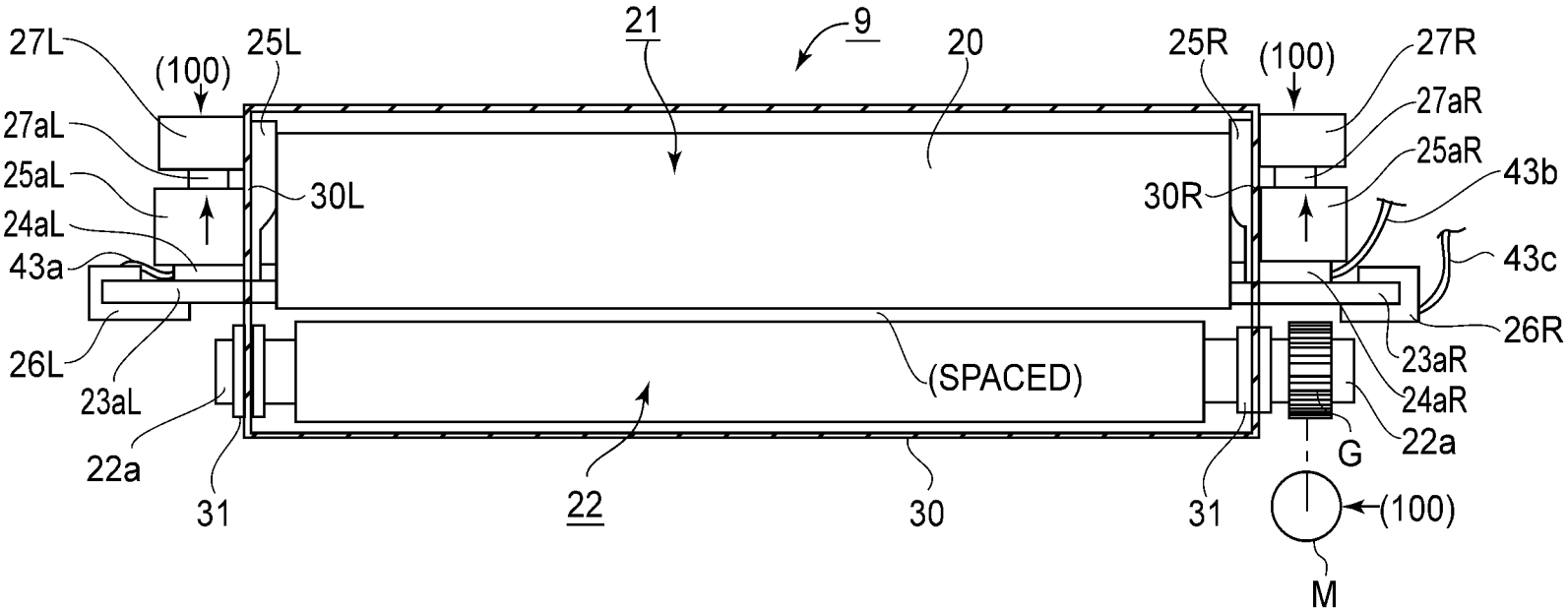
FIG. 8 is a front view of the fixing device in the first embodiment when the fixation belt and pressure roller of which are separated.

At this point of time, if the mechanism (devices) 27L and 27R for moving the belt backing member 23 is off, the control circuit 100 turns on the mechanisms 27L and 27R. That is, if the belt 20 and pressure roller 22 are kept pressed upon each other, the control circuit 100 separates the belt 20 from the pressure roller 22 as shown in FIG. 8 (Steps B2 and B30.

Next, the control circuit 100 turns on the electric power source 102 to begin supplying the heat generation layer 20*b* of the belt 20 with electric power through the aforementioned power supply system (Step B4). As the belt 20 is heated, and the temperature T1 of the belt 20 detected by the thermistor TH reaches 120° C. (Step B5), the control circuit 100 starts the formation of a toner image on the drum 3 of each image formation station (Step B6).

Then, a sheet P of the recording medium, on which an unfixed toner image t is borne, is conveyed to the fixing device 9. Then, the control circuit 100 stops supplying the left and right devices 27L and 27R for moving the belt backing member 23, with electric power, with such a timing that the sheet of the recording medium P arrives at a point which is 20 mm upstream from the fixation nip N in terms of the recording medium conveyance direction (Step B7). That is, the control circuit 100 allows the belt 20 to be pressed upon the pressure roller 22 (Step B8). Then, it turns on the motor M. Thus, the pressure roller 22 begins to be driven (Step B9). That is, the pressure roller 22 begins to be rotated in the counterclockwise direction indicated by the arrow mark 22 in FIG. 2, at a preset peripheral velocity.

The steps thereafter, that is, Steps B11-B13, are the same as Steps A7-A10, and therefore, are not described here.

Figure 13:
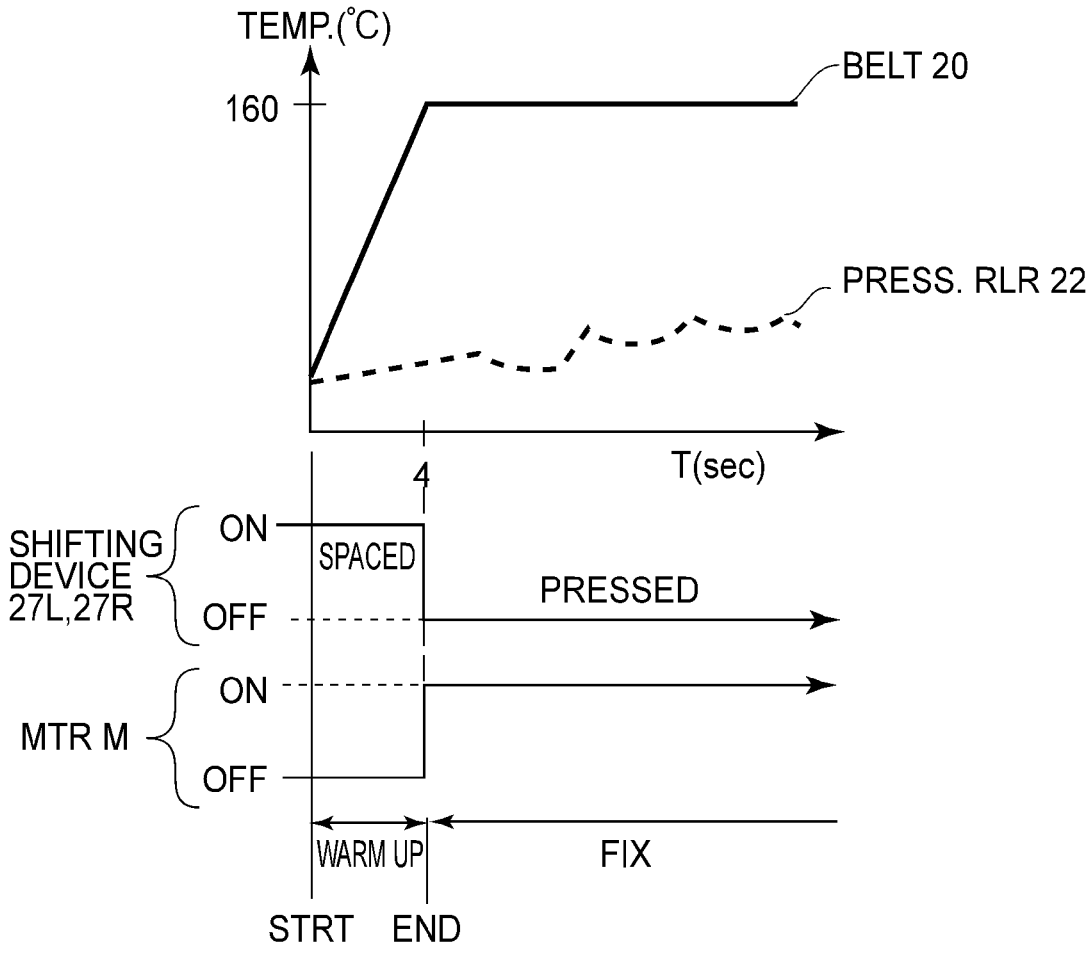
FIG. 13 is a drawing for showing the changes in the temperature of the fixation belt and pressure roller of the fixing device in the second embodiment, which occur during the period between the starting of the warming up of the fixation belt and pressure roller, and the starting of the fixation, and those which occur during the period thereafter.

FIG. 13 shows the changes which occurred to the temperature of the belt 20 and pressure roller 22 during the period between the starting of the warming up of the belt 20 and pressure roller 22, and after the beginning of fixation. The solid lines represent the changes in the temperature of the fixation belt, and the broken lines represent the changes in the temperature of the pressure roller.

In the case of the fixing device 9 in this embodiment, the belt 20 is kept separated from the pressure roller 22 during the warm-up time. Therefore, heat does not transfer from the belt 20 to the pressure roller 22 during the warm-up time. That is, all the heat generated in the heat generation layer 20*b* of the belt 20 is used for heating the belt 20. Therefore, the fixing device 9 in this embodiment is substantially shorter in the length of the warm-up time than the fixing device 9 in the first embodiment. Incidentally, the length of time it takes to warm up the fixing device 9 in this embodiment is roughly four seconds.

As described above, the fixing device 9 in this embodiment is structured so that while the belt 20 is warmed up, the belt 20 is kept separated from the pressure roller 22. Therefore, all the heat generated in the heat generation layer 20*b* of the belt 20 is used for heating the belt 20. Therefore, the fixing device 9 in this embodiment is substantially shorter in the length of the warm-up time than the fixing devices in the first embodiment. Further, it is structured so that the belt 20 is pressed upon the pressure roller 22 immediately before a sheet P of the recording medium reaches the nip N. Therefore, the decrease in the temperature of the belt 20 as the belt 20 is pressed upon the pressure roller 22 is minimized.

[Miscellanies]

1) The application of the present invention is not limited to a fixing device, the pressure applying member of which for worming the nip N between itself and the belt 20, is in the form of a roller. That is, the present invention is also applicable to a fixing device, the pressure applying member of which is a circularly movable endless belt.

2) The application of the present invention is not limited to a fixing device structured so that when a sheet of the recording medium is conveyed through the fixing device, the centerline of the sheet, in terms of the direction perpendicular to the recording medium conveyance direction, coincides with the centerline of the recording medium passage of the fixing device. That is, the present invention is also applicable to a fixing device structured so that when a sheet of the recording medium is conveyed through the fixing device, one of the lateral edges of the sheet, in terms of the recording medium conveyance direction, coincides with the corresponding edge of the recording medium passage of the fixing device.

3) The choice of an apparatus as which the image heating apparatus in accordance with the present invention is used is not limited to a fixing device for fixing an unfixed image formed on a sheet of the recording medium, to the sheet. That is, the image heating apparatus in accordance with the present invention is also effective as a heating apparatus which applies heat and pressure to a permanently fixed image, or a temporarily fixed image, on a sheet of the recording medium, in order to modify (improve) the image in surface properties, such as gloss.

4) The choice of an apparatus with which the present invention is compatible is not limited to an image forming apparatus, the image formation stations of which are electrophotographic. For example, the present invention is also compatible with an image forming apparatus, the image formation stations of which uses an electrostatic recording method or a magnetic recording method. Further, the choice of an apparatus with which the present invention is compatible is not limited to an image forming apparatus of the transfer type. That is, the present invention is also compatible with an image forming apparatus which directly forms an unfixed image on a sheet of the recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 231335/2011 filed Oct. 21, 2011 which is hereby incorporated by reference.

What is claimed is:

1. An image heating apparatus comprising:

an endless belt provided with a heat generation layer configured to heat an image on a sheet;

a driving rotatable member cooperative with said endless belt to nip and feed the sheet therebetween and configured to drive said endless belt;

a pressing pad configured to press said endless belt toward said driving rotatable member;

an electric energy supply device configured to supply electrical energy to said heat generation layer; and a shut-off element configured to break an electric connection between said electric energy supply device and said heat generation layer when the temperature of said endless belt reaches a predetermined upper limit temperature, wherein said shut-off element is disposed to contact said endless belt in a region, with respect to a widthwise direction of said endless belt, outside a passing region of a maximum width of the sheet usable with said apparatus and inside of a heat generating region of said heat generation layer.

2. An apparatus according to claim 1, wherein said shut-off element contacts an inner surface of said endless belt.

3. An apparatus according to claim 2, further comprising an urging portion configured to urge said shut-off element toward said endless belt.

4. An apparatus according to claim 3, wherein said urging portion is mounted to said pressing pad.

5. An apparatus according to claim 1, further comprising a controller configured to execute a warming-up process for supplying electrical energy to said heat generation layer by said electric energy supply device in a state that a rotation for said endless belt is not effected by said driving rotatable member.

6. An apparatus according to claim 5, further comprising a moving mechanism configured to contact and space said endless belt and said driving rotatable member relative to each other, wherein said controller is configured to keep said endless belt and said driving rotatable member spaced from each other during the warming-up process.

7. An apparatus according to claim 6, further comprising a temperature sensor configured to detect the temperature of said endless belt, said temperature sensor being disposed spaced from said endless belt inside a passing region of a minimum width of the sheet usable with said apparatus, with respect to a widthwise direction of said endless belt.

8. An apparatus according to claim 7, wherein said controller is configured to cause said moving mechanism to contact said endless belt and said driving rotatable member to each other to rotate said endless belt when the detected temperature detected by said temperature sensor reaches a predetermined temperature by said warming-up process.

9. An apparatus according to claim 7, wherein said controller is configured to shut off the electrical energy supply to said heat generation layer by said electric energy supply device when the detected temperature detected by said temperature sensor reaches a predetermined upper limit temperature.

10. An apparatus according to claim 1, wherein said endless belt includes a base layer inside said heat generation layer, a parting layer outside said heat generation layer, and an electric energy supply portion configured to supply the electric energy to said heat generation layer.

11. An apparatus according to claim 1, wherein said shut-off element includes a temperature fuse.

12. An apparatus according to claim 1, wherein the image is an unfixed image, said image heating apparatus fixes the unfixed image on the sheet in the nip.

* * * * *